US007136610B2

(12) United States Patent
Arai et al.

(10) Patent No.: US 7,136,610 B2
(45) Date of Patent: Nov. 14, 2006

(54) IMAGE FORMING APPARATUS USING INSTALLABLE PROCESS CARTRIDGE, METHOD OF POSITIONING PROCESS CARTRIDGE, AND PROCESS CARTRIDGE ITSELF

(75) Inventors: Yuji Arai, Kawasaki (JP); Atsushi Sampe, Yokohama (JP); Kiyonori Tsuda, Yokohama (JP); Takeo Suda, Tokyo (JP); Satoshi Hatori, Yokohama (JP); Tomoji Ishikawa, Yokohama (JP); Naoto Watanabe, Yokohama (JP); Hiroyuki Nagashima, Yokohama (JP); Yoshiyuki Kimura, Tokyo (JP); Nobuo Kuwabara, Yokohama (JP); Hiroshi Hosokawa, Yokohama (JP); Hideki Zemba, Yokohama (JP); Wakako Murakami, Tokyo (JP); Satoshi Narumi, Yokohama (JP); Ryuta Takeichi, Yokohama (JP); Masanori Kawasumi, Yokohama (JP); Kazuhiko Umemura, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/788,488

(22) Filed: Mar. 1, 2004

(65) Prior Publication Data

US 2004/0170447 A1 Sep. 2, 2004

(30) Foreign Application Priority Data

Feb. 28, 2003 (JP) ..... 2003-054072

(51) Int. Cl.
*G03G 21/18* (2006.01)

(52) U.S. Cl. ..... 399/111; 399/110

(58) Field of Classification Search ..... 399/110, 399/111, 112, 113, 107, 117
See application file for complete search history.

(56) References Cited

U.S. PATENT DOCUMENTS 4,969,015 A 11/1990 Sanpe (Continued)

FOREIGN PATENT DOCUMENTS

EP 0 895 137 2/1999

(Continued)

OTHER PUBLICATIONS

U.S. Appl. No. 11/226,197, filed Sep. 15, 2005, Kimura et al.

(Continued)

*Primary Examiner*—Louis M. Arana
(74) *Attorney, Agent, or Firm*—Oblon, Spivak, McClelland, Maier & Neustadt, P.C.

(57) ABSTRACT

A method and apparatus of image forming include a process cartridge detachably mounted therein. The process cartridge includes a photoconductive element and a housing storing the photoconductive element and including a guide portion guiding the process cartridge. The guide portion faces an inner wall of the image forming apparatus or another process cartridge adjoining thereto and guides the adjoining process cartridge. The guide portion slidably engages with a portion of the process adjoining cartridge. The guide portion varies in shape according to its position in the image forming apparatus. The guide portion may be separately formed from or integrated with the housing. A method and apparatus of an image forming includes an image transfer mechanism and a plurality of process cartridges arranged in parallel. Each of the process cartridges includes photoconductive elements and a housing, and forms an image for a single separated color.

18 Claims, 17 Drawing Sheets

U.S. PATENT DOCUMENTS 5,014,094 A * 5/1991 Amitani et al. ..... 399/12
5,109,254 A 4/1992 Oka et al.
5,198,841 A 3/1993 Sakamoto
5,235,384 A 8/1993 Oka et al.
5,258,809 A 11/1993 Wiedemer
5,386,274 A 1/1995 Sanpe et al.
5,416,568 A 5/1995 Yoshiki et al.
5,532,795 A 7/1996 Tatsumi et al.
5,552,877 A 9/1996 Ishikawa et al.
5,565,973 A 10/1996 Fujishiro et al.
5,614,998 A 3/1997 Sanpe
5,617,198 A 4/1997 Ishikawa et al.
5,638,158 A 6/1997 Sanpe et al.
5,646,721 A 7/1997 Sugihara et al.
5,659,860 A 8/1997 Sasaki et al.
5,663,788 A 9/1997 Sanpe
5,671,470 A 9/1997 Maruta et al.
5,678,125 A 10/1997 Kutsuwada et al.
5,758,235 A 5/1998 Kosuge et al.
5,758,241 A 5/1998 Oyama et al.
5,761,576 A 6/1998 Sugihara et al.
5,765,059 A 6/1998 Kosuge et al.
5,768,664 A 6/1998 Kosuge et al.
5,771,426 A 6/1998 Oka et al.
5,771,429 A 6/1998 Oyama et al.
5,784,669 A 7/1998 Miura et al.
5,787,328 A 7/1998 Sugihara et al.
5,805,965 A 9/1998 Tsuda et al.
5,815,767 A 9/1998 Kutsuwada et al.
5,822,664 A 10/1998 Oka et al.
5,826,146 A 10/1998 Maruta et al.
5,848,329 A * 12/1998 Aoyama et al. ..... 399/113
5,850,586 A 12/1998 Sugihara et al.
5,887,224 A 3/1999 Mizuishi et al.
5,913,092 A 6/1999 Bisaiji et al.
5,915,143 A 6/1999 Watanabe et al.
5,915,155 A 6/1999 Shoji et al.
5,915,156 A 6/1999 Kizaki et al.
5,940,664 A 8/1999 Sugihara et al.
5,956,549 A 9/1999 Sugihara et al.
5,991,569 A 11/1999 Sugihara et al.
5,999,772 A 12/1999 Kakitani et al.
6,006,050 A 12/1999 Watanabe et al.
6,026,255 A 2/2000 Kizaki et al.
6,055,388 A 4/2000 Watanabe et al.
6,055,394 A 4/2000 Suda et al.
6,070,037 A 5/2000 Sugihara et al.
6,072,967 A 6/2000 Sugihara et al.
6,097,914 A 8/2000 Tanaka et al.
6,101,351 A 8/2000 Suda et al.
6,104,900 A 8/2000 Ishikawa et al.
6,122,469 A 9/2000 Miura et al.
6,125,243 A 9/2000 Shoji et al.
6,141,520 A 10/2000 Kosuge
6,198,895 B1 3/2001 Tsuda et al.
6,256,459 B1 7/2001 Hasegawa et al.
6,256,465 B1 7/2001 Yoshinaga et al.
6,336,013 B1 1/2002 Suda et al.
6,336,020 B1 1/2002 Ishikawa et al.
6,337,957 B1 1/2002 Tamaki et al.
6,463,233 B1 * 10/2002 Kojima et al. ..... 399/111
6,463,237 B1 10/2002 Suda et al.
6,522,855 B1 2/2003 Katoh et al.
6,560,414 B1 5/2003 Suda et al.
6,597,881 B1 7/2003 Hatori et al.
6,601,991 B1 8/2003 Sampe
6,615,013 B1 9/2003 Arai et al.
2001/0028810 A1 10/2001 Yamaguchi et al.
2002/0146257 A1 10/2002 Nakazato et al.
2003/0180057 A1 9/2003 Sawada et al.
2004/0170447 A1 9/2004 Arai et al.

FOREIGN PATENT DOCUMENTS

EP 1 126 332 8/2001
JP 10-39718 2/1998
JP 2002-132011 5/2002

OTHER PUBLICATIONS

U.S. Appl. No. 11/247,269, filed Oct. 12, 2005, Uchiyama et al.
U.S. Appl. No. 11/269,717, filed Nov. 9, 2005, Fujimori et al.
U.S. Appl. No. 11/182,863, filed Jul. 18, 2005, Hosokawa et al.

* cited by examiner

IMAGE FORMING APPARATUS USING INSTALLABLE PROCESS CARTRIDGE, METHOD OF POSITIONING PROCESS CARTRIDGE, AND PROCESS CARTRIDGE ITSELF

BACKGROUND OF THE INVENTION

This patent specification is based on Japanese patent application, No.JPAP2003-054072 filed on Feb. 28, 2003 in the Japanese Patent Office, the entire contents of which are incorporated by reference herein.

FIELD OF THE INVENTION

The present invention relates to a method and apparatus for image forming, and more particularly to a mechanism in the method and apparatus for positioning a process cartridge which houses a combination of image forming devices.

DISCUSSION OF THE BACKGROUND

An image forming apparatus, such as a copier, a printer, or a facsimile, visualizes an electrostatic latent image formed on a latent image carrier, i.e., a photoconductor, with a developer, and transfers the image visualized onto a sheet or the like, thereby obtaining a recorded output.

As a configuration for an image forming apparatus, the image forming apparatus may adopt, besides a configuration using single photoconductor for one color, a configuration including a plurality of photoconductors to form a plurality of corresponding colored images. The image forming apparatus with a plurality of photoconductors is used for forming a multi-colored image such as a full-colored image.

In order to obtain a full-colored image, for example, one applicable method is sequentially superimposing each of the colored images formed on the photoconductors with developer having a complementary color of a separated color onto a sheet being conveyed. Another method is transferring a plurality of images from each of the photoconductors one by one onto a common position of an intermediate transferor and then transferring an image superimposed thereon onto a sheet at one time.

As a configuration of using a plurality of photoconductors, what is called tandem architecture is generally known. In the tandem architecture, photoconductors for each color are parallely arranged in an extending direction of a belt which works as an intermediate transferor receiving images superimposed from photoconductors thereon, as described in Japanese Patent Laid-Open Application Publication No. 10-39718, for instance.

Japanese Patent Laid-Open Application Publication No. 10-39718 proposes, for instance, a configuration capable of forming a multi-colored image like the tandem architecture in which a cartridge for image forming is installed into an image forming apparatus. The process cartridge accommodates a combination of a photoconductor and image forming devices carrying out an image forming process thereon.

Each image forming device installed in the process cartridge needs to have specified alignment in order to prevent generated image from being defective. In order to meet this requirement, a configuration has been provided capable of independently positioning a developing device and a cleaning device used in the process cartridge in relation to the photoconductor.

In an image forming apparatus of forming a multicolored image with a plurality of process cartridges, a photoconductor in a process cartridge needs to have a specified position in relation to other photoconductor, that is, it needs to maintain registration, when the process cartridge is installed. This configuration is necessary in order to prevent color displacement caused by transfer displacement among one-color images.

In order to install the process cartridges into the image forming apparatus, a member installed in the apparatus has been used such as a guiding rail or a drawer capable of sliding and holding the cartridges. However, the growing demand for smaller image forming apparatus in recent years requires more compact configuration, demanding optimized space utilization between the process cartridges, which space has been occupied traditionally with guiding rails or drawers.

In addition, conventional apparatuses have configuration that requires the specification of a relative position of each image forming device to the photoconductor installed in the process cartridge. Likewise, each process cartridge positioning of itself in relation to other process cartridges.

SUMMARY OF THE INVENTION

In view of the foregoing, it is an object of the present invention to provide a novel process cartridge used in an image forming apparatus which includes a guiding portion for guiding the process cartridge.

Another object of the present invention is to provide a novel method of providing a process cartridge in an image forming apparatus which includes a guiding portion for guiding the process cartridge.

To achieve these and other objects, in one example, the present invention provides a novel process cartridge including a photoconductive element and a housing. The housing houses the photoconductive element and includes a guide portion guiding the process cartridge.

The guide portion of the process cartridge may face an inner wall of the image forming apparatus or another process cartridge adjoining it.

The guide portion may also guide another adjoining process cartridge.

The guide portion may slidably engage with a portion of an adjoining process cartridge.

The guide portion may vary in shape in accordance with a location in the image forming apparatus.

The guide portion may be separately formed from the housing or be integrated there with.

The present invention also provides a novel image forming apparatus including an image transfer mechanism and a process cartridge detachably mounted. The process cartridge includes a photoconductive element and a housing. The housing houses the photoconductive element and includes a guide portion guiding the process cartridge.

The present invention also provides a novel image forming apparatus including an image transfer mechanism and a plurality of process cartridges detachably mounted and arranged in line in parallel. Each one of the plurality of process cartridges forms an image for a single separated color, and includes a photoconductive element and a housing. The housing houses the photoconductive element and includes a guide portion guiding the process cartridge.

This patent specification further describes a novel method of providing a process cartridge detachably mounted in an image forming apparatus.

In one example, the novel method includes the steps of providing a photoconductive element and storing the photoconductive element. The providing step provides the photoconductive element. The storing step stores the photoconductive element in a housing including a guide portion guiding the process cartridge.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
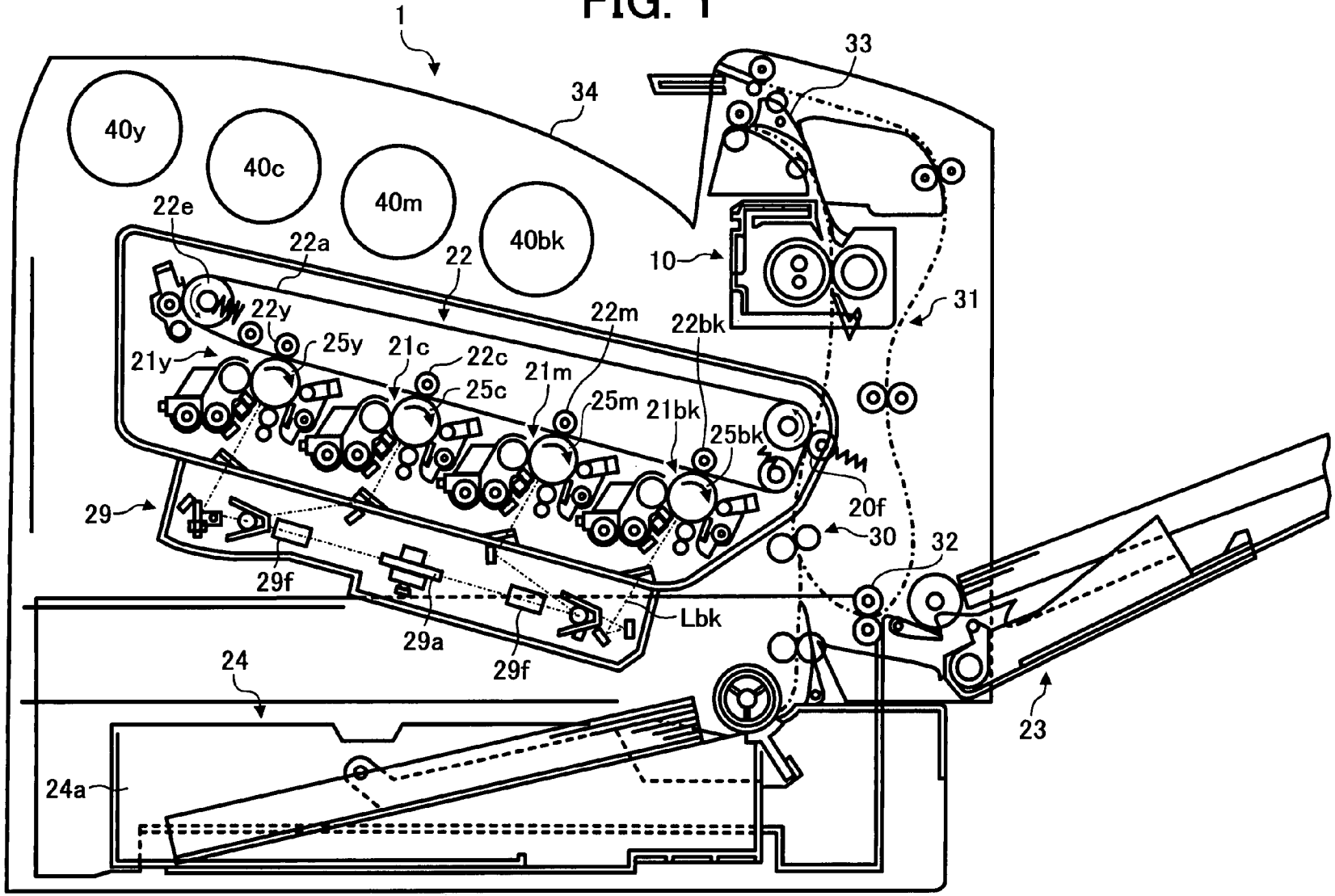
FIG. 1 is a schematic diagram showing an exemplary configuration of an image forming apparatus adopting process cartridges according to an embodiment of the present invention.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner. Referring now to the drawings, wherein like reference numerals designate identical or corresponding parts throughout the several views, particularly to FIGS. 1 and 2, an image forming apparatus 1 according to an exemplary embodiment of the present invention is described. In FIG. 1, the image forming apparatus 1 includes a fusing device 10, a transfer device 20, a transfer belt 20*a*, a driving roller 20*e*, a secondary bias transferor 20*f*, image forming mechanisms 21*y*, 21*c*, 21*m*, and 21*bk*, and bias transferors 22*y*, 22*c*, 22*m*, and 22*bk*. The image forming apparatus 1 shown in FIG. 1 further includes a manual feeding tray 23, a paper feeding device 24, a paper feeding cassette 24*a*, photoconductive drums 25*y*, 25*c*, 25*m*, and 25*bk*, a writing device 29, a polygon motor 29*a*, and f lenses 29*f*. The image forming apparatus 1 shown in FIG. 1 also includes registration rollers 30, a reverse circulating path 30, feeding rollers 31, a conveying-path switcher 32, a paper output tray 34, and toner supply tanks 40*y*, 40*c*, 40*m*, and 40*bk*.

Figure 2:
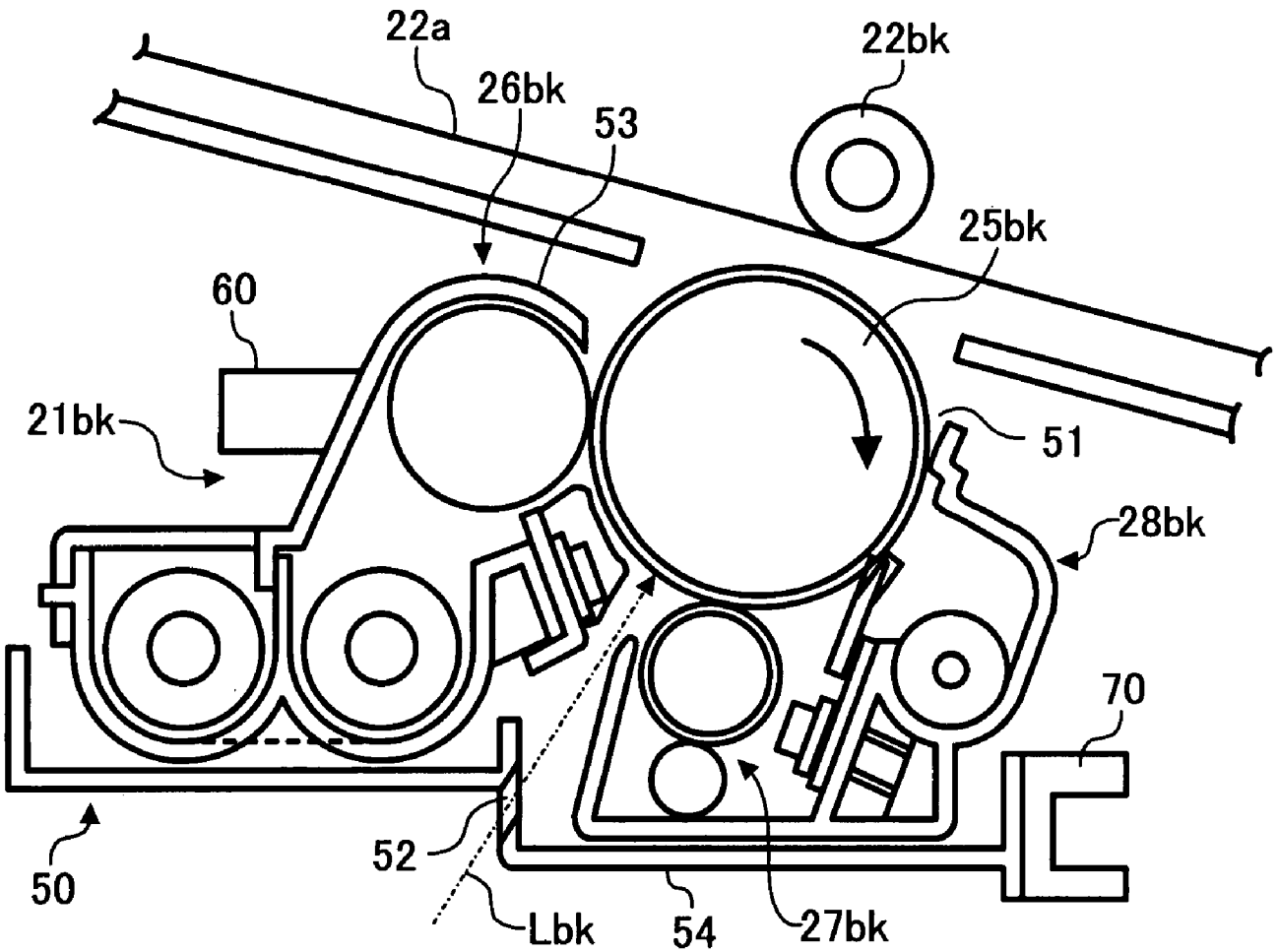
FIG. 2 is a schematic diagram showing an enlarged view of one of the process cartridges equipped in the image forming apparatus in FIG. 1.

As shown in FIG. 2, the image forming apparatus 1 further includes a developing device 26*bk*, a cleaning device 27*bk*, and a charging device 28*bk* in the image forming mechanism 21*bk*. The image forming apparatus 1 in FIG. 2 also includes a process cartridge 50, an opening 51, an introducing mouth 52, a top wall 53, a bottom wall 54, guiding members 60 and 70 attached to the process cartridges 50, and guiding members 80 and 90.

FIGS. 1 and 2 also show a writing laser beam Lbk and arrows indicating rotating directions of the photoconductive drums 25.

The image forming mechanisms 21*y*, 21*c*, 21*m*, and 21*bk* form images of yellow, cyan, magenta, and black color, respectively, according to an original image. The transferors 22*y* through 22*bk* faces the image forming mechanisms 21*y* through 21*bk*, respectively. The manual feeding tray 23 and the paper feeding cassette 24*a* feed a recording sheet into a transfer area in which the image forming mechanisms 21*y* through 21*bk* and the transferors 22*y* through 22*bk* are opposed each other, respectively. The paper feeding cassette 24*a* is placed in the paper feeding unit 24. The registration rollers 30 feed the recording paper sent from the manual feeding tray 23 or the paper feeding cassette 24*a* in synchrony with operations of the image forming mechanisms 21*y* through 21*bk*. The fusing device 10 carries out a fusing operation on the recording sheet having an image transferred from the transfer device 20.

The fusing device 10, adopting a heat roller fusing method, fixes the image onto the recording sheet through a process of melting, softening, and penetrating by using a heating roller and a platen roller. The heating roller and the platen roller may be placed side by side of a conveying path of the recording sheet.

The transfer device 20 includes the transfer belt 20*a* wound on a plurality of rollers, working as a transfer member. The transfer device 20 also includes the bias transferors 22*y*, 22*c*, 22*m*, and 22*bk* facing corresponding drums 25*y*, 25*c*, 25*m*, and 25*bk* in the image forming mechanisms 21*y*, 21*c*, 21*m*, and 21*bk*, respectively. The bias transferors 22*y*, 22*c*, 22*m*, and 22*bk* apply transfer bias having reversed polarity of toner to sequentially superimpose toner images formed with the image forming mechanisms onto the transfer belt 20*a*.

The image transfer device 20 further includes a secondary bias transferor 20*f* located on a conveying path of the recording sheet,transfering toner images superimposed on the transfer belt 20*a* onto the recording sheet.

In the image forming apparatus 1 shown in FIG. 1, the transfer device 20 is disposed inside of the image forming device 1 on a slope, thereby occupying less space horizontally.

The image forming apparatus 1 in FIG. 1 is an example of a color printer adopting a tandem method capable of forming a full-colored image. At the same time, the present invention is equally applicable to other image forming apparatus, such as, for example, a copier, a facsimile, a duplicator, or the like as an image forming apparatus as well.

In addition to normal paper generally used for copying, the image forming apparatus 1 is able to process specific paper having higher heat capacity such as 90K paper including OHP sheet, cards, or postcards, cardboard having a specific weight of 100 g/m2 or more, or envelopes.

The image forming mechanisms 21*y*, 21*c*, 21*m*, and 21*bk* in FIG. 1 carry out development of yellow, cyan, magenta, and black images, respectively. As all image forming mechanisms have identical arrangements except a color of toner, only the image forming mechanism 21*bk* will be described as a representative example.

The photoconductive drum 25*bk* in the image forming mechanism 21*bk* works as an electrostatic latent image carrier. Along with the rotating direction indicated with arrows in FIGS. 1 and 2 of the photoconductive drum 25*bk*, the charging device 27*bk*, the developing device 26*bk*, and the cleaning device 28*bk* are sequentially arranged. At a location between the charging device 27*bk* and the developing device 26*bk* on the photoconductive drum 25*bk*, a latent image according to an image information corresponding to a separate color is formed with the writing laser beam Lbk emitted from the writing device 29. As an electrostatic latent image carrier, a beltlike shaped member may be adopted instead of a drum-shaped member. These devices for image forming arranged around the photoconductive drum 25*bk* are combined into the process cartridge 50 which is configured to have a unit structure and a housing, as shown in FIG. 2.

In the image forming apparatus 1 of the above configuration, an image is formed according to the following processes and conditions. The following example describes the image forming mechanism 21*bk* using black toner as a representative image forming mechanism. It is to be noted, however, that the image forming mechanisms of other colors are configured in a similar manner.

In an image forming process, the photoconductive drum 25*bk* is driven to rotate by a main motor (not shown), and first discharged with alternating current (AC) bias having no direct current (DC) component applied to the charging device 27*bk*. The photoconductive drum 25*bk* thus have its surface potential set to standard potential of approximately −50V.

Subsequently, the charging device 27*bk* applies a DC bias superimposed to AC bias the photoconductive drum 25*bk*. The photoconductive drum 25*bk* is evenly charged to have a surface potential equivalent to the DC component charged, i.e., approximately −500V to approximately −700V. A preferable value of the surface potential is determined by a process controlling unit.

Upon completion of the uniform charging of the photoconductive drum 25*bk*, a writing process starts. An image is written with the writing device 29 according to digital image information from a controller (not shown) in order to form a latent image. That is, in the writing device 29, a laser light source emits a laser beam based on a digitized signal for each color according to the digital image information. The laser beam passes through cylinder lens (not shown), the polygon motor 29*a*, the f6 lenses 29*f*, first, second, and third mirrors, and the WTL lens (not shown). The photoconductive drum carrying an image of each color, in this case the photoconductive drum 25*bk*, is irradiated with the laser beam. Each area on the surface of the photoconductive drum 25*bk* irradiated to have a surface potential of approximately −50V, thereby forming a latent image according to the image information.

The latent image formed on the photoconductive drum 25*bk* is visualized by the toner applied thereto by the developing device 26*bk*. A developing process then applies a voltage signal to a developing sleeve of approximately −300V to approximately −500V DC with an AC bias in order to develop the toner (Q/M: −20 to −30 μC/g) on image areas having lower potential caused by the irradiation of the laser beam, thereby forming the toner image.

A toner image of each color visualized in the developing process is transferred onto the recording sheet being fed with a predetermined timing from the registration rollers 30. The recording sheet is applied attaching bias from rollers before reaching the transfer belt 22*a*. The recording sheet thus attaches to the transfer belt 22*a* due to electrostatic.

Each of the bias transferors 22*y*, 22*c*, 22*m*, and 22*bk* installed in the transfer device 20 and facing the respective photoconductive drum applies a bias having reversed polarity of toner onto the transfer belt 20*a*. This action causes the photoconductive drums to electrostatically transfer toner images onto the transfer belt 20*a*. The toner images superimposed on the transfer belt 20*a* are finally transferred to the recording sheet by the secondary bias transferor 20*f*.

The recording sheet with each color image transferred is self stripped from the transfer belt 22*a* with the driving roller 22*b* of a transfer belt unit, and conveyed to the fusing device 10. The toner image is fixed onto the recording sheet as it passes through a fusing nip including a fusing belt and pressing rollers. The recording sheet then is ejected onto the paper output tray 34.

The image forming apparatus 1 shown in FIG. 1 is capable of forming a double-sided image on the recording sheet ejected from the fusing process, as well as a single-sided image. When forming a double-sided image, the recording sheet exiting the fusing process is conveyed to a reversal circulating path 31 by use of registration rollers 30 and feeding rollers 32. The feeding rollers 32 are also used to feed a sheet placed on the manual feeding tray 23. The conveying path of the recording sheet is switched by a conveying path switcher 33 installed at a rearward location of the fusing device 10, depending whether a single-sided or double-sided image is being formed.

It is to be understood that each of the above-described features, such as, for example, charging potentials is not limited to values and attributes stated in the above description, but may vary naturally based on other operating parameters, such as, for example, color and/or density.

FIG. 2 illustrates an exemplary configuration of the process cartridge 50 formed with a housing molded from resinous material. The image forming mechanism 21*bk* for a black colored image is provided, on its housing, with the opening 51 on a side facing the transfer belt 20*a* for exposing a part of the photoconductive drum 25*bk*, and the writing light introducing mouth 52 on the other side facing the writing device 29.

The process cartridge 50 is attached or detached along a line substantially in a longitudinal direction, or an axis of the photoconductive drum 25*bk*. In the present embodiment, the attaching/detaching line is perpendicular to a sheet surface of the FIG. 2 from which the process cartridge 50 can be withdrawn for maintenance or inspection.

Figure 3:
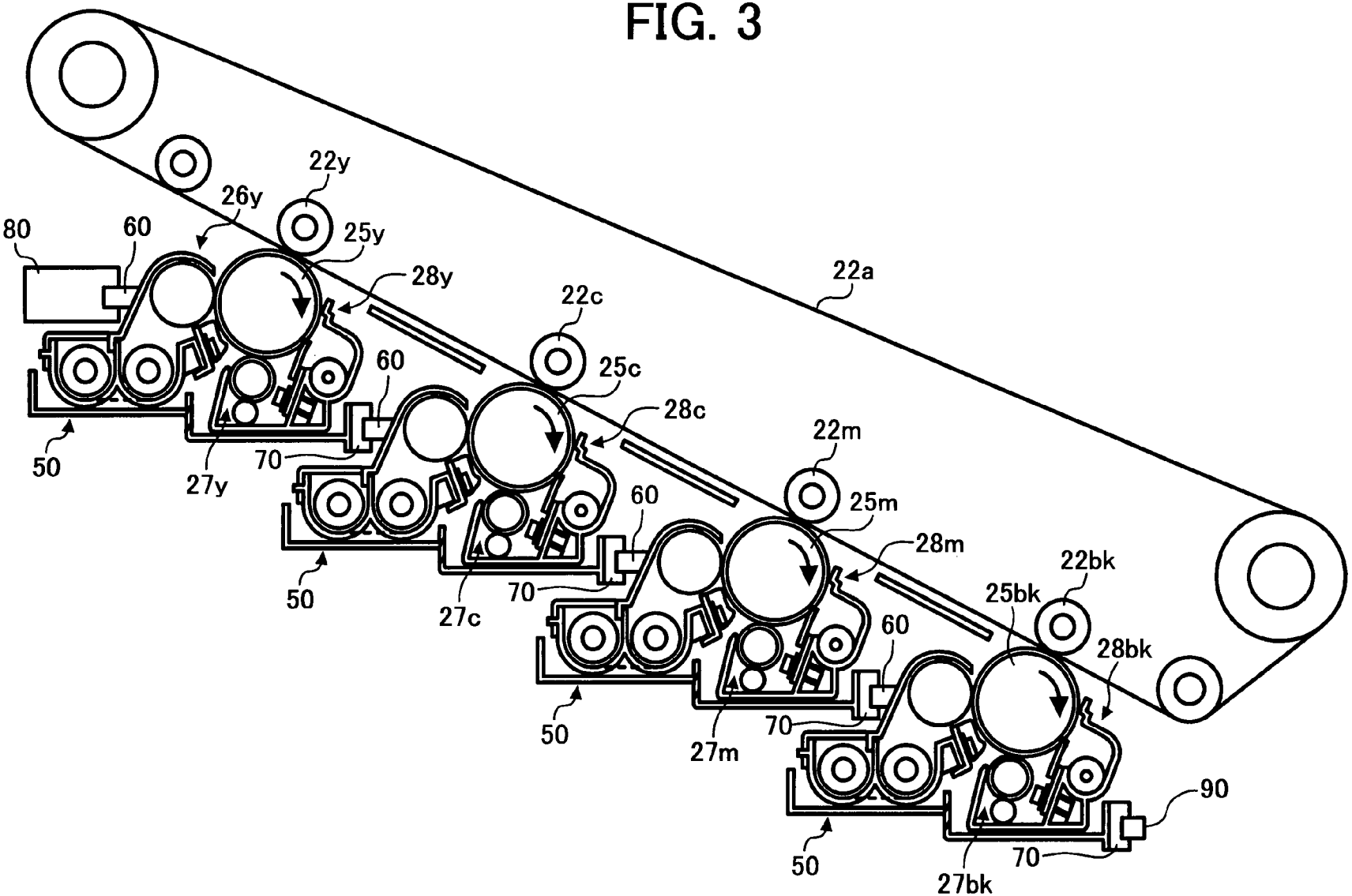
FIG. 3 is a schematic diagram illustrating a guiding mechanism structure with a plurality of process cartridges similar to the one shown in FIG. 2.
Figure 4:
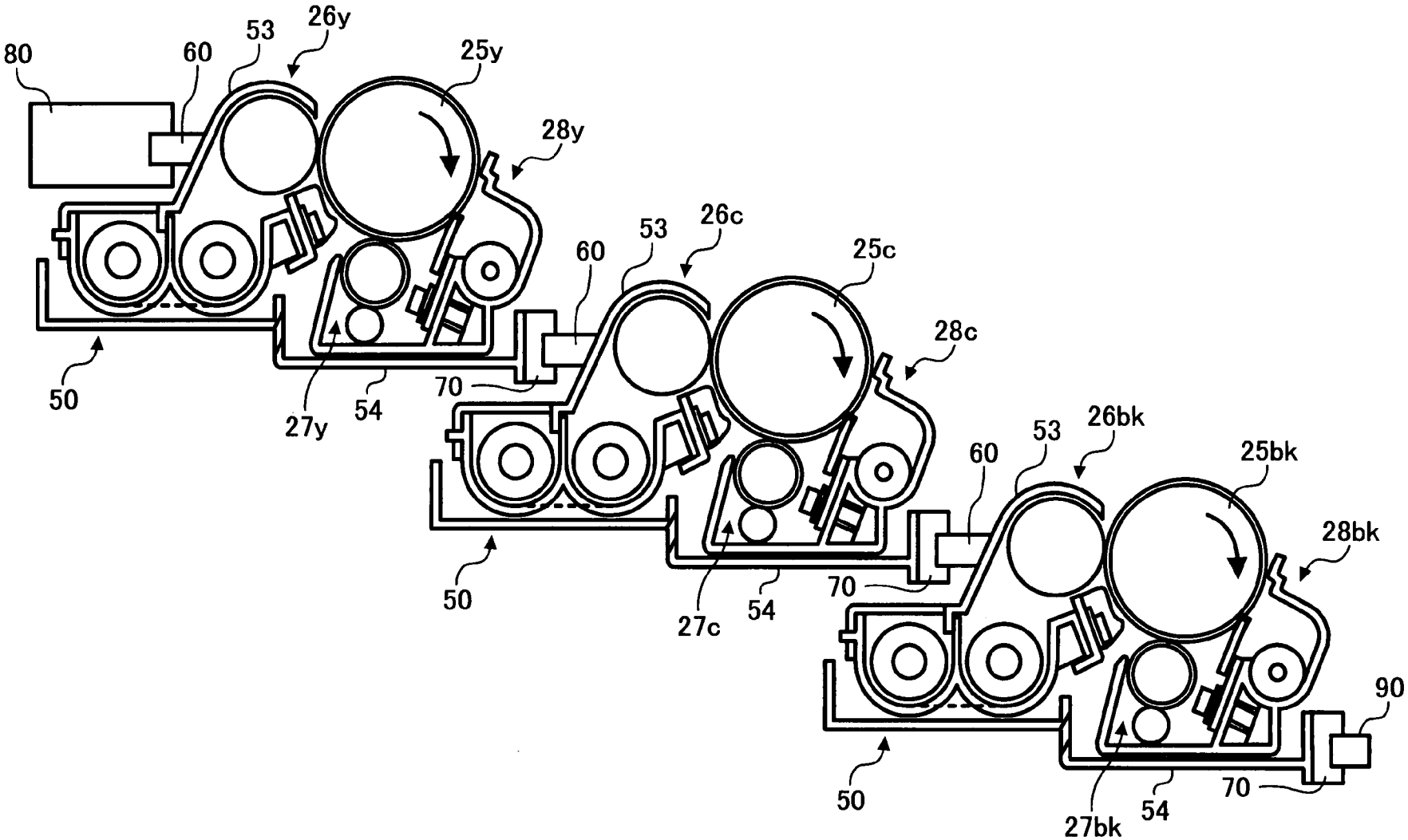
FIG. 4 is a schematic diagram showing an enlarged view of a part of the structure shown in FIG. 3.

Referring to FIGS. 3 and 4, further details of the image forming apparatus 1 will now be described. In FIG. 3 and FIG. 4, on an outer wall of the process cartridge 50, the top wall 53 of the developing device 26*bk* facing adjoining process cartridge is provided with the guiding member 60 while the bottom wall 54 of the cleaning device 28*bk* is provided with guiding member 70. The process cartridge 50 for magenta color is omitted in FIG. 4.

As shown in FIG. 3, the guiding member 80 is placed inside the housing contacting the guiding member 60 attached to the process cartridge 50 on the left side to guide the process cartridge 50 being attached or detached. Similarly, the guiding member 90 is placed inside the housing contacting the guiding member 70 attached to the process cartridge 50 on the right side to guide the process cartridge 50 being attached or detached.

Each of the guiding members 60 and 70 is arranged to face the adjoining process cartridge. The guiding member 60 is formed to protrude as a male member, while the guiding member 70 is formed to recess as a female member engaging the guiding member 60. Each of the guiding members 60 and 70 is provided with enough length to hold travel of attachment/detachment of the process cartridge 50 along a line perpendicular to the page in FIGS. 3 and 4.

Since the guiding members 60 and 70 are configured to protrude and recess, respectively, they are able to fit each other, as shown in FIG. 4. When the guiding members 60 and 70 fit each other, a tip of the guiding member 60 is inserted and engaged to the guiding member 70. In this configuration, space between the process cartridges is reduced in comparison to a mounting process using guiding members without engagement.

Each of the guiding members 60 and 70 in a state of engagement pushes against a wall of the adjoining process cartridge 50. This configuration assures that the needed amount of space between process cartridges 50 is maintained, thereby enabling the positioning of adjacent process cartridges 50 to each other.

The guiding members 60 and 70 may be formed separately from the housing of the process cartridge 50 and attached thereto afterward, or formed together with the housing of the process cartridge 50.

In the former case, the guiding members 60 and 70 may be joined or fastened to the housing of the process cartridge 50.

According to the above configuration, the process cartridge 50 moving inward in the image forming apparatus 1 is able to use the guiding members 60 and 70 of the adjoining process cartridges 50. Moreover, when loaded in the image forming apparatus 1, each process cartridge 50 is able to keep its position therein because the guiding members 60 and 70 determine the amount of space between the process cartridges 50. The guiding members 60 and 70 enable movement of the process cartridges 50 by beading its weight. Each of the guiding members 60 and 70 is separately placed from the other, side by side of a vertical centerline of the process cartridge 50. According to this configuration, the process cartridge 50 just receives gravity at horizontal relative positions, and is capable of sliding without receiving any couple of force. As a matter of course, each of the guiding members 60 and 70 of the process cartridge 50 has an appropriately sized tip at a horizontal end to fit an opponent so that the process cartridge 50 slides smoothly without receiving any additional external horizontal force. The above configuration eliminates the necessity of the image forming apparatus 1 to have a member for guiding the process cartridge 50 in motion or positioning the process cartridge 50, thereby reducing the space occupied by the process cartridges 50, and the overall size of the image forming apparatus 1.

Figure 5:
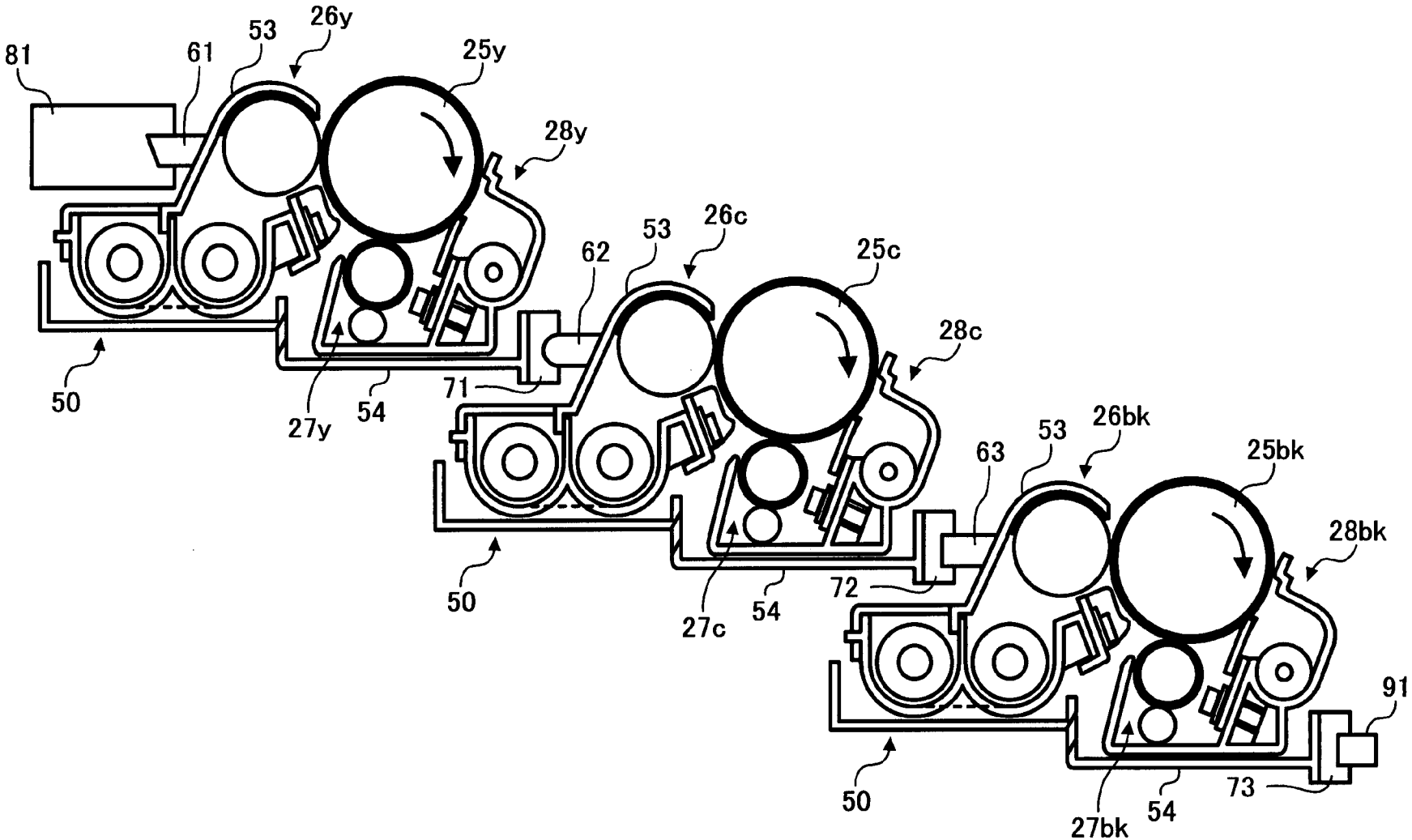
FIG. 5 is a schematic diagram showing another exemplary structure of guiding members in process cartridges installed in the image forming apparatus shown in FIG. 1.

Referring now to FIG. 5, another embodiment of the image forming apparatus 1 according to the present invention will now be described. FIG. 5 includes guiding members 61, 62, 63, 71, 72, and 73 instead of the guiding members 60 and 70 in FIGS. 2 through 4. Guiding members 81 and 91 of the image forming apparatus are also shown in FIG. 5 as substitutes of guiding members 80 and 90. Other reference numbers in FIG. 5 are identical with the reference numbers in the first embodiment. The tip shape of each of the guiding members 61, 62, and 63, respectively, varies for each process cartridge 50 in order to fit the corresponding other guiding member 71, 72, and 73.

In the exemplary embodiment shown in FIG. 5, the process cartridge 50 in the left includes the guiding member 61 having a protruding slanting tip which fits the guiding member 81, and the guiding member 71, having a recessing arcing tip. The process cartridge 50 in the middle includes the guiding member 62, having a protruding arcing tip which fits the recessing arcing tip of the guiding member 71, and the guiding member 72, having a recessing rectangular tip. The process cartridge 50 in the right includes the guiding member 63, having a protruding rectangular tip which fits the recessing rectangular tip of the guiding member 72, and the guiding member 73, having a recessing rectangular tip which fits the guiding member 91.

The above configuration prevents misplacing of the process cartridge 50 in the image forming apparatus 20 housing a plurality of process cartridges to form separate color images. Into a position at which each of the guiding members 61, 62, and 63 and 71, 72, and 73 matches its opponent, the process cartridge 50 can be loaded. This consequently determines a loading position of the process cartridge 50 taking into consideration the correct order. The guiding members 61, 62, and 63 and 71, 72, and 73 thus allow the loading position to be identified based on the shapes process of the different guiding members of each cartridge 50 to be installed in the image forming apparatus 1.

Figure 6:
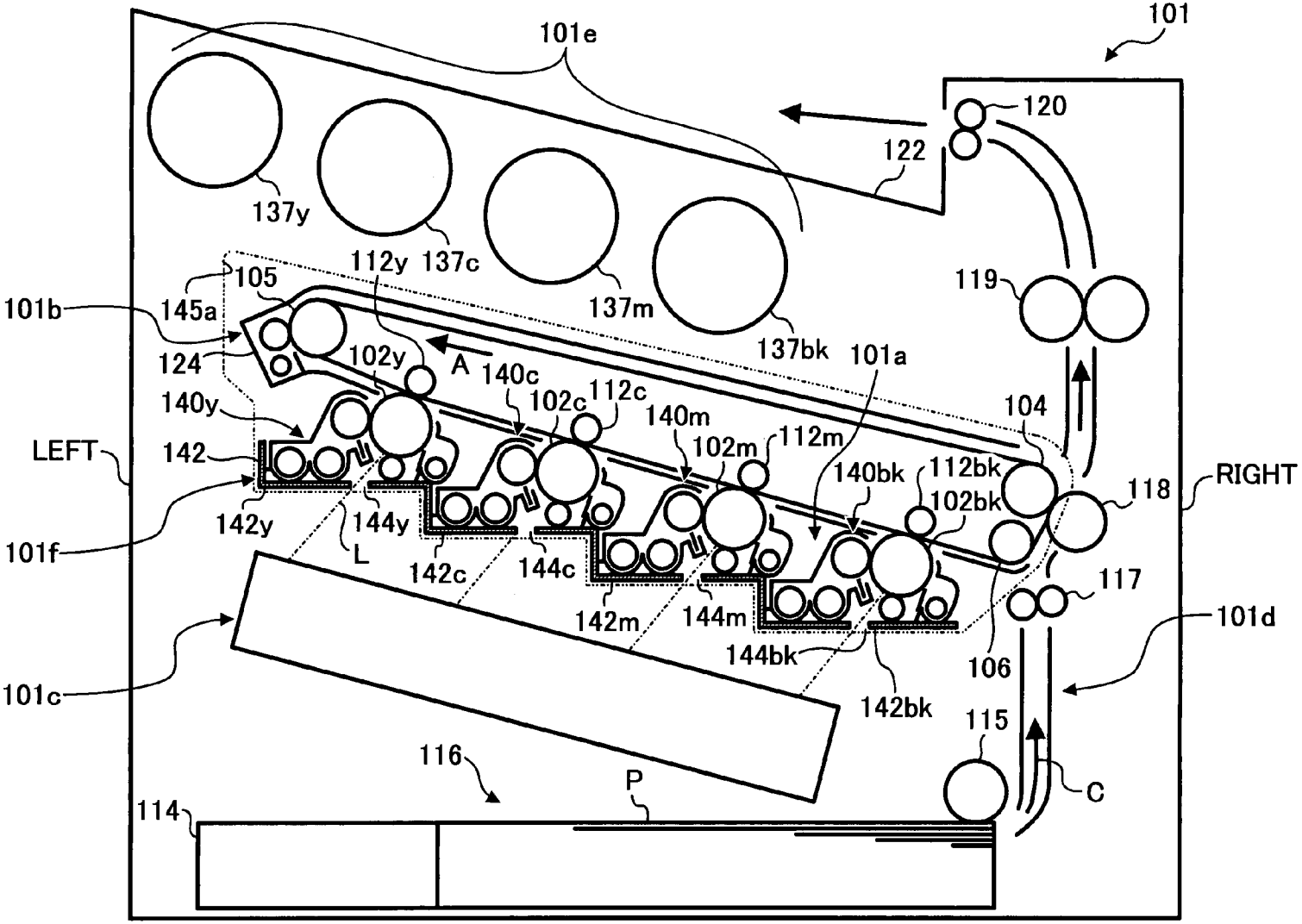
FIG. 6 illustrates a vertical sectional view of a fullcolor image forming apparatus according to another embodiment of the present invention.

Referring to FIG. 6, another embodiment of the present invention will now be described. In FIG. 6, an image forming apparatus 100 is shown that includes an image forming mechanism 101*a*, a transfer medium 101*b*, an optical writing system 101*c*, a sheet feeding mechanism 101*d*, a toner feeding mechanism 101*e*, and a guiding mechanism 101*f*.

Figure 7:
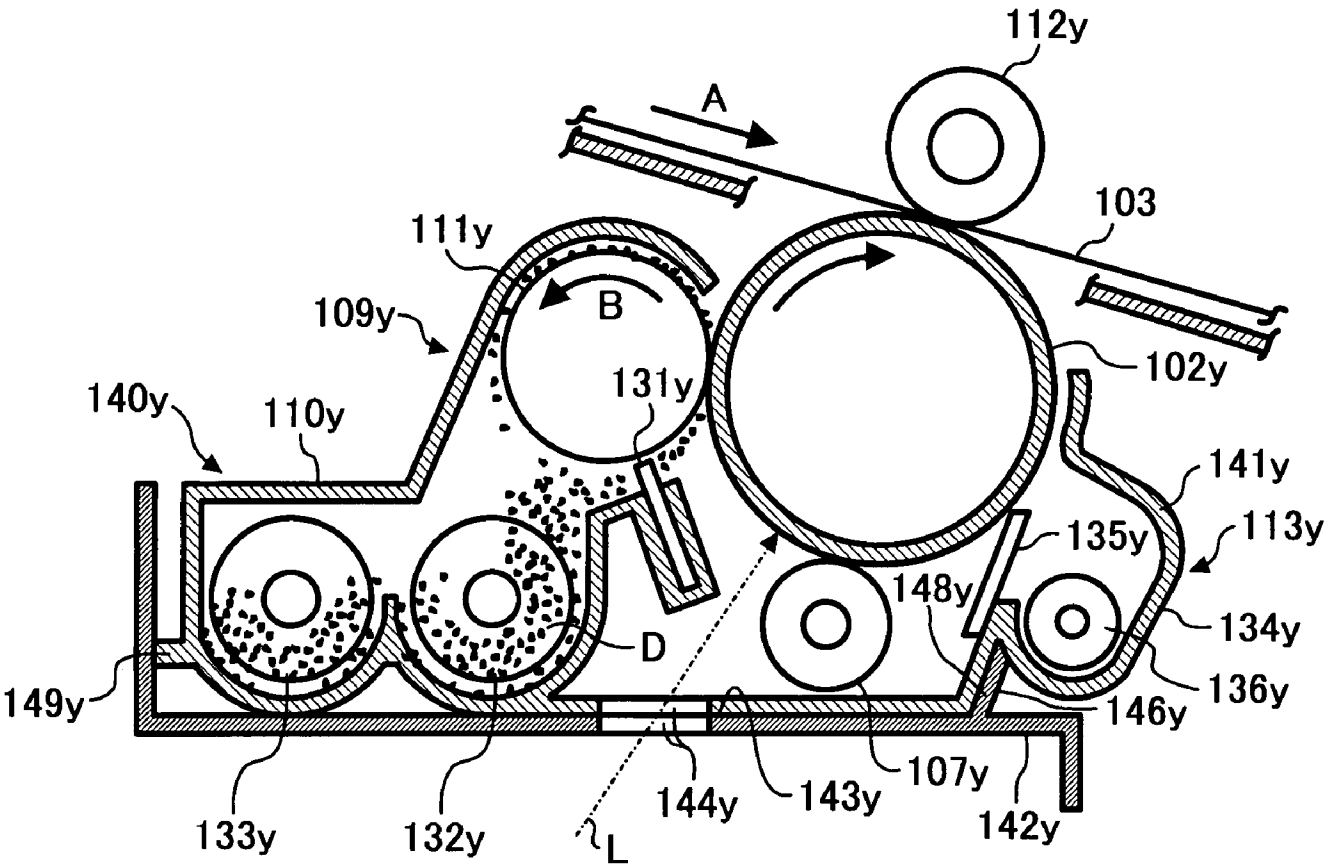
FIG. 7 illustrates an enlarged sectional view of an image carrying member and an image forming mechanism arranged around the image carrying member.

The image forming mechanism 101*a* generally includes four process cartridges 140*y*, 140*c*, 140*m*, and 140*bk* which are explained with reference to FIG. 7. FIG. 7 illustrates an enlarged sectional view of that process cartridge, focusing on operations of the process cartridge 140*y*. The process cartridges 140*y*, 140*c*, 140*m*, and 140*bk* have identical structures with toners of different colors. The process cartridge 140*y* includes an image carrying member 102*y* and various image forming components including a charging roller 107*y*, a developing unit 109*y*, and a cleaning unit 113*y*. The developing unit 109*y* includes a developing roller lily, a developing blade 131*y*, and toner conveying screws 132*y* and 133*y*. The parts of the developing unit 109*y* are encased in a developing case 110*y* that contains a dry-type developer D. The cleaning unit 113*y* includes a cleaning blade 135*y* and a collected-toner conveying screw 136*y*. The parts of the cleaning unit 113*y* are encased in a cleaning case 134*y*. According to the image forming apparatus 100 of the present invention, the developing case 110*y* and the cleaning case 134*y* are integrally mounted to form a unit case 141*y*. The unit case 141*y* has a light passing window 144*y* at the bottom thereof.

The transfer medium 101*b* includes an intermediate transfer belt 103. The intermediate transfer belt 103 is supported by a plurality of supporting rollers 104, 105, and 106, and is held in contact with primary transfer rollers 112*y*, 112*c*, 112*m*, and 112*bk* which correspond to the image carrying members 102*y*, 102*c*, 102*m*, and 102*bk*, respectively.

The optical writing system 101*c* includes an optical writing device (not shown).

The sheet feeding mechanism 101*d* includes a sheet feeding cassette 114, a sheet feeding roller 115, a sheet feeding unit 116, a registration roller pair 117, a secondary transfer roller 118, a fusing unit 119, a sheet discharging roller pair 120, a sheet discharging part 122, and a belt cleaning unit 124.

The toner feeding mechanism 101*e* includes toner bottles 137*y*, 137*c*, 137*m*, and 137*bk*.

The guiding mechanism 101*f* includes a guide 142 having guide portions 142*y*, 142*c*, 142*m*, and 142*bk* which are explained with reference to FIG. 8. The guide portions 142*y*, 142*c*, 142*m*, and 142*bk* have supporting surfaces 143*y*, 143*c*, 143*m*, and 143*bk*, and guide protrusions 146*y*, 146*c*, 146*m*, and 146*bk*, respectively.

The image forming apparatus 100 of the present invention also includes an opening 145*a* (shown in FIG. 10) on a front side panel thereof.

The intermediate transfer belt 103 is arranged above the image forming mechanism 101*a* at a predetermined angle relative to the horizontal plane with one end of the intermediate transfer belt 103 close to the supporting roller 105 higher than the other end thereof. The predetermined angle is preferably in a range from approximately 10 degrees to approximately 20 degrees, and is preferably approximately 15 degrees.

The image forming apparatus 100 produces a full-color image through the following operations. The optical writing system 101*c* emits laser beams to the image forming mechanism 101*a* supported by the guiding mechanism 101*f*. The image forming mechanism 101*a* produces different color images with toners which are conveyed by the toner feeding mechanism 101*e*, and transfers the images one after another onto the transfer medium 101*b* to form a superimposed full-color image. The transfer medium 101*b* then transfers the superimposed fullcolor image onto a recording medium fed by the sheet feeding mechanism 101*d*. The full-color image transferred onto the recording medium 101*b* is fixed and then discharged onto the top of the image forming apparatus 100.

Referring to FIG. 7, operations of the image forming mechanism 101*a* are explained. As previously described, the process cartridges 140*y*, 140*c*, 140*m*, and 140*bk* have identical structures. Therefore, an explanation will be given focusing on the operations performed by the process cartridge 140*y*. The image carrying member 102*y* has a drum-shaped photoconductive element and forms an electrostatic latent image for a single color toner image on its surface. The image forming components are arranged around the image carrying member 102*y* and form the single color toner image based on the electrostatic latent image formed on the image carrying member 102*y*.

The image carrying member 102*y* rotates clockwise. The charging roller 107*y* is applied with a charged voltage and then charges the image carrying member 102*y* to a predetermined polarity to form an electrostatic latent image on the image carrying member 102*y*. The optical writing system 101*c* emits and irradiates the image carrying member 102*y* with a laser beam L.

The developing unit 109*y* visualizes the electrostatic latent image as a yellow toner image. The developing roller lily is rotatably supported by the developing case 110*y* and is closely placed opposite to the image carrying member 102*y* through an open space formed on the developing case 110*y*.

The developing blade 131*y* regulates an amount of the dry-type developer D on the developing roller lily. The toner conveying screws 132*y* and 133*y* are oppositely provided to the developing roller lily. The dry-type developer D in the developing case 110*y* is agitated by the toner conveying screws 132*y* and 133*y*, carried onto the surface of the developing roller lily, and then conveyed by the developing roller lily rotating in a direction B, as indicated in FIG. 7. The developing blade 131*y* regulates the dry-type developer D accumulated on the surface of the developing roller 111*y* to a fixed level. The dry-type developer D of the regulated amount adhering on the developing roller lily is conveyed to a developing area formed between the developing roller lily and the image carrying member 102*y*. In the developing area, toner contained in the dry-type developer D is electrostatically transferred onto an electrostatic latent image formed on the surface of the image carrying member 102*y* such that the electrostatic latent image becomes visualized as a toner image. The dry-type developer D may be a one-or a two-component developer. The present invention preferably uses a two-component developer including toner and carriers.

As shown in FIG. 6, the intermediate transfer belt 103 that serves as the transfer medium 101*b* forms an endless belt extended with pressure among the plurality of supporting rollers 104, 105, and 106, and rotates in a direction A.

The intermediate transfer belt 103 is arranged with an angle to a horizontal plane in an obliquely downward direction from left (LEFT) to right (RIGHT) of the image forming apparatus 100 in FIG. 6. The intermediate transfer belt 103 is held in contact with the primary transfer roller 112*y* arranged at a position opposite to the image carrying member 102*y* such that the toner image formed on the surface of the image carrying member 102*y* is transferred onto the intermediate transfer belt 103 to superimpose different color toner images to obtain a recorded image. The primary transfer roller 112*y* receives a transfer voltage and primarily transfers a yellow toner image onto the surface of the intermediate transfer belt 103 by an action of the transfer voltage.

As shown in FIG. 7, after the yellow toner image is transferred onto the intermediate transfer belt 103, the cleaning unit 113*y* scrapes the surface of the image carrying member 102*y* to remove residual toner adhering to the surface of the image carrying member 102*y*.

The cleaning unit 113*y* is encased by the cleaning case 134*y* that has an opening relative to the image carrying member 102*y*. The cleaning blade 135*y* has a base edge fixedly supported by the cleaning case 134*y* and a leading edge pressed onto the surface of the image carrying member 102*y* to scrape the residual toner adhering to the surface of the image carrying member 102*y*. The collected-toner conveying screw 136*y* conveys removed toner to a toner collecting bottle (not shown).

A voltage generated by a current that includes a direct current alternating current superimposed to is applied to the charging roller 107*y*. The charging roller 107*y* then simultaneously discharges and charges the surface of the image carrying member 102*y* with the voltage applied thereto. Namely, the image carrying member 102*y* is prepared for the next image forming operation, i.e., a yellow toner image is formed thereon and transferred onto the intermediate transfer belt 103.

Through operations similar to those as described above, a cyan toner image, a magenta toner image, and a black toner image are formed on the surfaces of the image carrying members 102*c*, 102*m*, and 102*bk*, respectively. Those color toner images are sequentially superimposed on the surface of the intermediate transfer belt 103 on which the yellow toner image is already formed, such that a primary superimposed toner image is formed on the intermediate transfer belt 103. After the toner images in the different colors are transferred, residual toner on the image carrying members 102*c*, 102*m*, and 102*bk* is also removed by the cleaning units 113*c*, 113*m*, and 113*bk*, respectively. As shown in FIG. 6, the image forming components have the same numbers as those corresponding to and arranged around the image carrying member 102*y*, with respective characters "c", "m" and "bk" according to their respective colors.

As shown in FIG. 6, the sheet feeding mechanism 101*d* is arranged at the lower part of the image forming apparatus 100.

The sheet feeding cassette 114 accommodates a plurality of recording media such as transfer sheets that include a recording medium P. The sheet feeding roller 115 provided at the top of the sheet feeding unit: 116 feeds recording media. When the sheet feeding roller 115 is rotated, the recording medium P, placed on the top of a sheet stack of recording media in the sheet feeding cassette 114, is fed in a direction C as indicated in FIG. 6. The recording medium P, fed from the sheet feeding cassette 114, is conveyed to the registration roller pair 117. The registration roller pair 117 stops and feeds the recording medium P in synchronization with a movement of the superimposed toner image towards a transfer area formed between the intermediate transfer belt 103 and the secondary transfer roller 118. The secondary transfer roller 118 is applied with an adequate predetermined transfer voltage such that a primary superimposed toner image, formed on the surface of the intermediate transfer belt 103, is transferred onto the recording medium P to form a secondary superimposed toner image.

The recording medium P that has the secondary superimposed toner image thereon is conveyed further upward and passes between a pair of fusing rollers of the fusing unit 119. The fusing unit 119 fixes the secondary superimposed toner image to the recording medium P by applying heat and pressure. After the recording medium P passes the fusing unit 119, the recording medium P is discharged face-down by the sheet discharging roller pair 120 to the sheet discharging part 122 provided at the upper portion of the image forming apparatus 100. The belt cleaning unit 124 scrapes the surface of the intermediate belt 103 and removes residual toner adhering onto the surface of the intermediate transfer belt 103.

As shown in FIG. 6, the toner bottles 137*y*, 137*c*, 137*m*, and 137*bk* of the toner feeding mechanism 101*e* are provided at the upper portion of the image forming apparatus 100 and contain yellow, cyan, magenta, and black toners, respectively. Yellow, cyan, magenta, and black toners are conveyed from the toner bottles 137*y*, 137*c*, 137*m*, and 137*bk*, respectively, through respective conveying paths (not shown) to supply the developing units 109*y*, 109*c*, 109*m*, and 109*bk*, respectively.

As previously described, a process cartridge (140*y*, 140*c*, 140*m*, and 140*bk*) is formed by an image carrying member (102*y*, 102*c*, 102*m*, and 102*bk*) and at least a part of the image forming mechanism 101*a*. The image carrying member (102*y*, 102*c*, 102*m*, and 102*bk*) has a surface on which an electrostatic latent image for a corresponding color out of predetermined colors is formed. The image forming mechanism 101*a* is integrally mounted with the image carrying member (102*y*, 102*c*, 102*m*, and 102*bk*). The image forming mechanism 101*a* is configured to form a toner image in a corresponding color based on the electrostatic latent image formed on the image carrying member (102*y*, 102*c*, 102*m*, and 102*bk*). The image forming apparatus 100 includes a plurality of process cartridges (140*y*, 140*c*, 140*m*, and 140*bk*) configured to transfer yellow, cyan, magenta, and black toner images, respectively, formed on the image carrying members 102*y*, 102*c*, 102*m*, and 102*bk*, respectively, into a full-color toner image onto the intermediate transfer belt 103. More specifically, in the process cartridge 140*y*, the developing case 110*y*, and the cleaning case 134*y* are integrally formed as a unit case 141*y*, as shown in FIG. 7. The image carrying member 102*y* is rotatably supported by the unit case 141*y*. The image carrying member 102*y*, developing unit 109*y*, cleaning unit 113*y*, and charging roller 107*y* are integrally mounted to form process cartridge 140*y*. As previously described, the process cartridge does not necessarily include an entire portion of the image forming mechanism. The process cartridge may include the image carrying member and at least one of the charging unit, the developing unit and the cleaning unit.

The image carrying members 102*y*, 102*c*, 102*m*, and 102*bk* are in contact with a bottom surface of the intermediate transfer belt 103 between the supporting rollers 105 and 106, and are arranged such that the supporting roller 105 is disposed higher than the supporting roller 106. As shown in FIG. 6, the process cartridges 140*y*, 140*c*, 140*m*, and 140*bk* may be removed in an axial direction of the image carrying members 102*y*, 102*c*, 102*m*, and 102*bk*, respectively.

Figure 8:
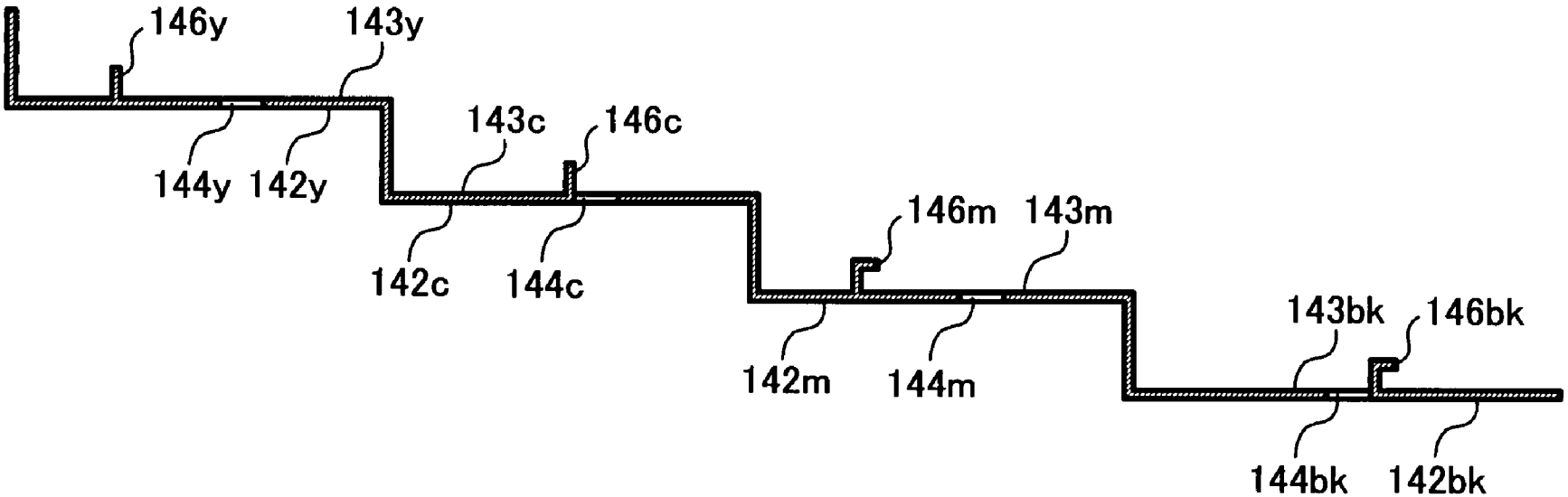
FIG. 8 illustrates a sectional view of a guide having guide portions arranged in a stepped manner.

FIG. 8 illustrates a sectional view of the guide 142 including the guide portions 142*y*, 142*c*, 142*m*, and 142*bk* arranged in a stepped manner, according to an embodiment of the present invention. The guide 142 includes the guide portions 142*y*, 142*c*, 142*m*, and 142*bk*, and is fixed to the image forming apparatus 100. The supporting surfaces 143*y*, 143*c*, 143*m*, and 143*bk* are mounted substantially horizontally and have respective bottom and side surfaces for supporting the process cartridges 140*y*, 140*c*, 140*m*, and 140*bk*. The supporting surfaces 143*y*, 143*c*, 143*m*, and 143*bk* guide the process cartridges 140*y*, 140*c*, 140*m*, and 140*bk* when the process cartridges 140*y*, 140*c*, 140*m*, and 140*bk* are inserted into or removed from the image forming apparatus 100. The supporting surfaces 143*y*, 143*c*, 143*m*, and 143*bk* are arranged at positions having different heights in a stepped manner according to positional heights of the process cartridges 140*y*, 140*c*, 140*m*, and 140*bk*. The guide portions 142*y*, 142*c*, 142*m*, and 142*bk* of the guide 142 support the process cartridges 140*y*, 140*c*, 140*m*, and 140*bk*, and have a predetermined angle to the horizontal plane and are arranged parallel to the intermediate transfer belt 103. The guide portions 142*y*, 142*c*, 142*m*, and 142*bk* and the unit cases 141*y*, 141*c*, 141*m*, and 141*bk* of the process cartridges 140*y*, 140*c*, 140*m*, and 140*bk* include the light passing windows 144*y*, 144*c*, 144*m*, and 144*bk*, respectively, for passing a laser beam L emitted by the optical writing system 101*c* to the image carrying members 102*y*, 102*c*, 102*m*, and 102*bk*, respectively. Further, as shown in FIG. 7, the developing case 110*y* includes a protrusion 149*y* in the vicinity of the toner conveying screw 133*y* such that the process cartridge 140*y* is guided along a vertical side of the guide portion 142*y*. The other developing cases 110*c*, 110*m*, and 110*bk* are arranged in a similar manner. Accordingly, the vertical side of the guide portion 142*y* is also used as a guide member for the process cartridge 140*y*.

Figure 10:
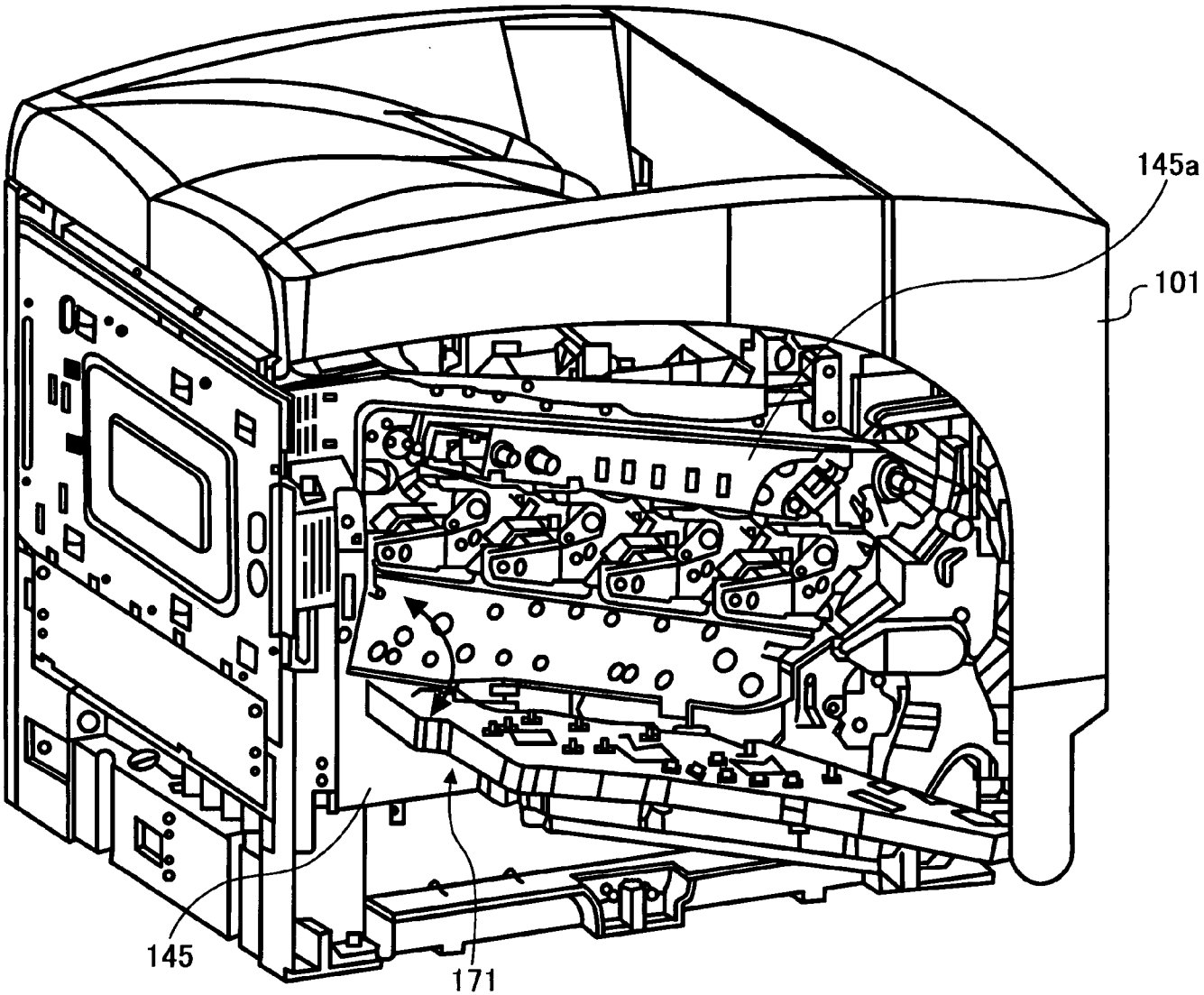
FIG. 10 illustrates a perspective view of the image forming apparatus of FIG. 11 with a front-side cover plate opened.

The image forming apparatus 100 includes an internal front panel 145 (see FIG. 10) disposed over an internal front side of the image forming apparatus 100 (the surface side of the figure). The internal front side panel 145 covers the internal portions of the image forming apparatus 100 including the process cartridges 140*y*, 140*c*, 140*m*, and 140*bk*, the intermediate transfer belt 103, and the optical writing system 101*c*. The internal front panel. 145 has an opening 145*a* formed as indicated by the chain double-dashed lines shown in FIG. 6. The process cartridges 140*y*, 140*c*, 140*m*, and 140*bk* are removable through the opening 145*a*. Further, the image forming apparatus 100 includes a cover plate 171 which is hingedly mounted to the internal front panel 145 to cover the opening 145*a*. The cover plate 171 may be opened and closed, and has a shape for determining with precision the positions of the process cartridges 140*y*, 140*c*, 140*m*, and 140*bk*. For instance, holes may be used for determining with precision the positions of the process cartridges 140*y*, 140*c*, 140*m*, and 140*bk*. When the cover plate 171 is set to a closed position, an engaging mechanism (not shown) completely fixes positions of the image carrying members of the process cartridges to perform the image forming operation. FIG. 10 illustrates a perspective view of the image forming apparatus 100 and shows a relationship between the opening 145*a* and the cover plate 171.

According to this configuration, when the process cartridge 140*y* is checked, repaired, or replaced, a user may pull the process cartridge 140*y* in a direction towards the user to detach it from the supporting surface 143*y*. The user may place and push the process cartridge 140*y* on the supporting surface 143*y* in a reverse direction to attach it. Namely, the user may remove and insert the process cartridge while keeping it horizontal. Therefore, there is no need to engage the slide rail provided on the process cartridge with the guide rail provided on the image forming apparatus. Further, by opening the cover plate 171 of the image forming apparatus 100, the user may instantly recognize the position of the supporting surface 143*y* and understand that the supporting surface 143*y* may be used to guide the process cartridge 140*y* when the process cartridge 140*y* is inserted or removed. Thus, even an inexperienced user may easily attach and detach the process cartridge 140*y* while keeping it horizontal. This process may also be applied to the other process cartridges 140*c*, 140*m*, and 140*bk*.

Further, the image forming apparatus 100 includes a regulating member configured to regulate a path of the process cartridge. The regulating member prevents the process cartridge from undesirable movements in a direction perpendicular to the path of the process cartridge along the plane of the supporting surface of the guide during attachment and detachment. Thus, the process cartridge does not cause interference and damage to another process cartridge placed next to it. As shown in FIG. 7, the guide portion 142*y* includes the regulating member that has a guide protrusion 146*y* protruding upward from the supporting surface 143*y* of the guide portion 142*y* and extending toward a removing direction of the process cartridge 140*y*. The guide protrusion 146*y* may be slidably engaged in a groove 148*y* formed on the unit case 141*y* of the process cartridge 140*y* to prevent the process cartridge 140*y* from undesirable movements in a direction perpendicular to the path of the process cartridge 140*y* during attachment and detachment. Alternatively, the process cartridge 140*y* may include the guide protrusion 146*y* and the supporting surface 143*y* may include the groove 148*y*. The processes described above relating to the yellow toner as indicated by the character "y" may also be applied to parts and units related to the cyan, magenta, and black toners as indicated by the characters "c", "m" and "bk".

In FIG. 8, the guide portions 142*y*, 142*c*, 142*m*, and 142*bk* may include the guiding protrusions 146*y*, 146*c*, 146*m*, and 146*bk*, and may have different shapes and mounting locations to properly engage respective grooves included in the process cartridges 140*y*, 140*c*, 140*m*, and 140*bk*.

Figure 9:
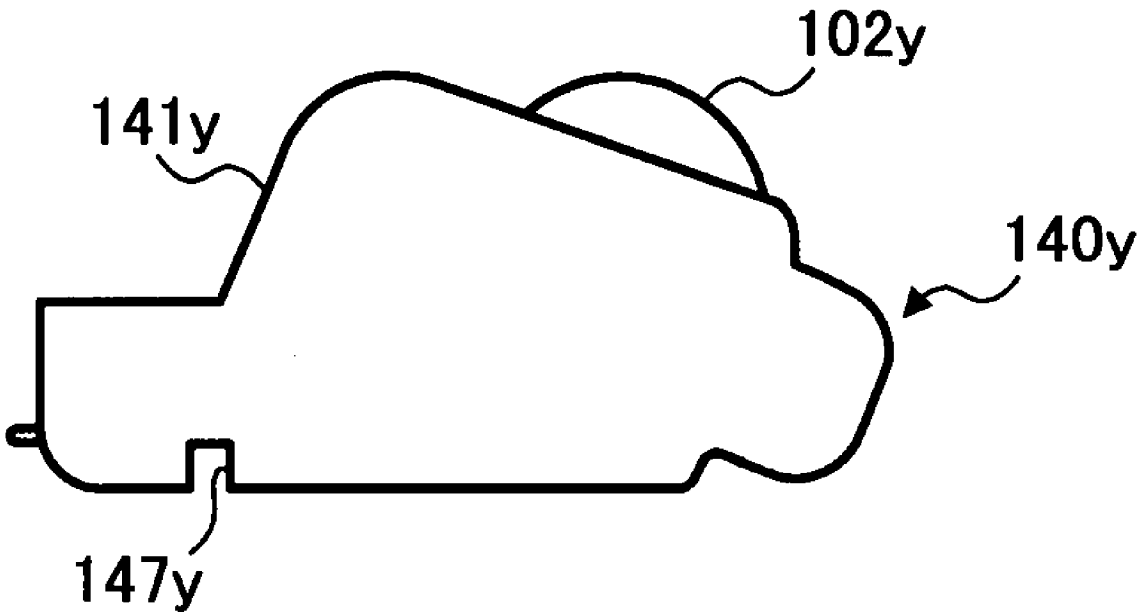
FIG. 9 illustrates a process cartridge provided with a guide groove and a guide protrusion.

FIG. 9 illustrates the unit case 141*y* of the process cartridge 140*y* that has a guide groove 147*y* thereon. The unit case 141*y* of the process cartridge 140*y* includes the guide groove 147*y* which may be engaged with the guide protrusion 146*y* included in the guide portion 144*y* close to the vertical side of the guide portion 144*y*, as shown in FIG. 8. Improper insertion of the process cartridges may be prevented by varying the form or the locations of the guide protrusions and the guide grooves. Alternatively, the guide portions 142*y*, 142*c*, 142*m*, and 142*bk* may include the guide grooves 147*y*, 147*c*, 147*m*, and 147*bk* and the process cartridges 140*y*, 140*c*, 140*m*, and 140*bk* may include the guide protrusions 146*y*, 146*c*, 146*m*, and 146*bk* such that the process cartridges 140*y*, 140*c*, 140*m*, and 140*bk* are prevented from being misaligned. Thus, an improper insertion of process cartridge may also be prevented. An erroneous supply of improper color toner to a developing unit may also be prevented. As a result, the quality deterioration of the image due to color toner mixture is avoided.

Further, the image forming apparatus 100 includes an elevating member (not shown) which allows the guide portions 142*y*, 142*c*, 142*m*, and 142*bk* to move vertically. When detaching the process cartridges 140*y*, 140*c*, 140*m*, and 140*bk*, the elevating member descends the guide portions 142*y*, 142*c*, 142*m*, and 142*bk* supporting the process cartridges 140*y*, 140*c*, 140*m*, and 140*bk* such that the image carrying members 102*y*, 102*c*, 102*m*, and 102*bk* separate from the intermediate transfer belt 103. The separation avoids rubbing and damaging the surfaces of the image carrying members 102*y*, 102*c*, 102*m*, and 102*bk*, and the surface of the intermediate transfer belt 103. The guide portions 142*y*, 142*c*, 142*m*, and 142*bk* may be configured to elevate collectively or individually. If the guide portions 142*y*, 142*c*, 142*m*, and 142*bk* are individually movable, a user can selectively descend the guide portions 142*y*, 142*c*, 142*m*, and 142*bk* to attach or detach a desired process cartridge.

Alternatively, the intermediate transfer belt 103 may be eliminated with the images directly transferred onto a recording paper sheet.

As shown in FIG. 6, the image forming apparatus 100 includes toner bottles 137*y*, 137*c*, 137*m*, and 137*bk* which are separately mounted to the process cartridges 140*y*, 140*c*, 140*m*, and 140*bk*, respectively. The toner bottles 137*y*, 137*c*, 137*m*, and 137*bk* of different colors are provided above the intermediate transfer belt 103 and correspond to the process cartridges 140*y*, 140*c*, 140*m*, and 140*bk*, respectively, such that each color toner is conveyed to a corresponding one of the process cartridges 140*y*, 140*c*, 140*m*, and 140*bk*. The toner bottles 137*y*, 137*c*, 137*m*, and 137*bk* may be replaced separately from the process cartridges 140*y*, 140*c*, 140*m*, and 140*bk* when a toner needs to be replenished. Also, the process cartridges 140*y*, 140*c*, 140*m*, and 140*bk* may be replaced separately from the toner bottles 137*y*, 137*c*, 137*m*, and 137*bk* when a component needs to be replaced. Thus, this structure allows separate exchanges of toner and process cartridges, thereby reducing the maintenance cost for the user. Therefore, the number of opening and closing operations of the cover plate 171 may be reduced and the number of replacements of the process cartridges may also be reduced. Thereby, toner scattering in an area such as a shutter area may be prevented and operator maintainability is improved.

Figure 11:
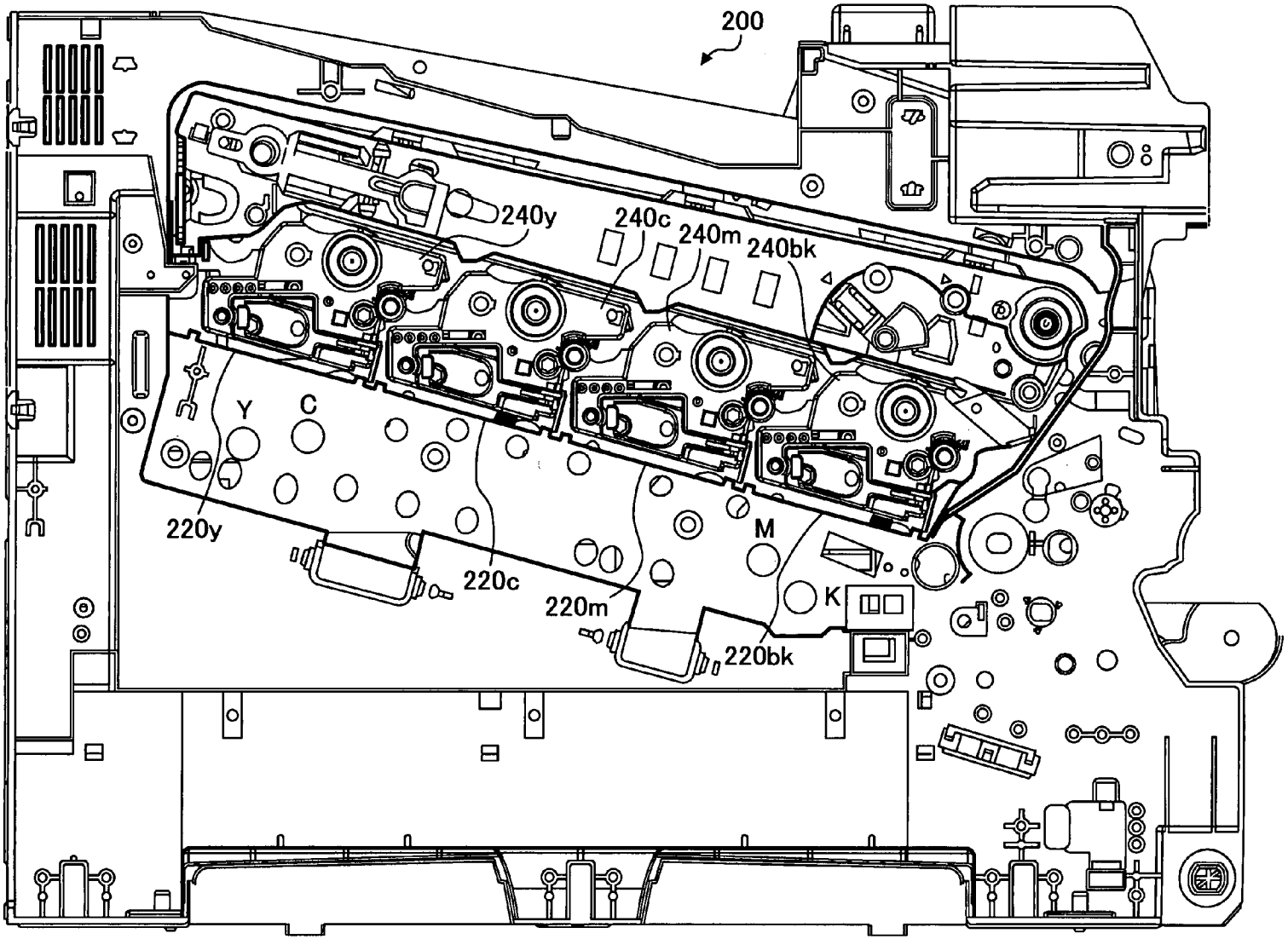
FIG. 11 illustrates a vertical sectional view of an image forming apparatus according to another embodiment of the present invention.

Next, an image forming apparatus 200 according to another embodiment of the present invention will be described with reference to FIGS. 6 through 12. FIG. 11 shows an image forming apparatus 200 that includes guide portions 220*y*, 220*c*, 220*m*, and 220*bk* and process cartridges 240*y*, 240*c*, 240*m*, and 240*bk*. The image forming apparatus 200 is similar to the image forming apparatus 100 of FIG. 6.

In the discussion following, suffix characters "y", "c", "m" and "bk" are attached to reference numbers of components and represent respective colors. Based on this suffix system, the following explanation primarily focuses on the yellow color mechanism section.

The remaining color mechanism sections have similar structures.

Figure 12:
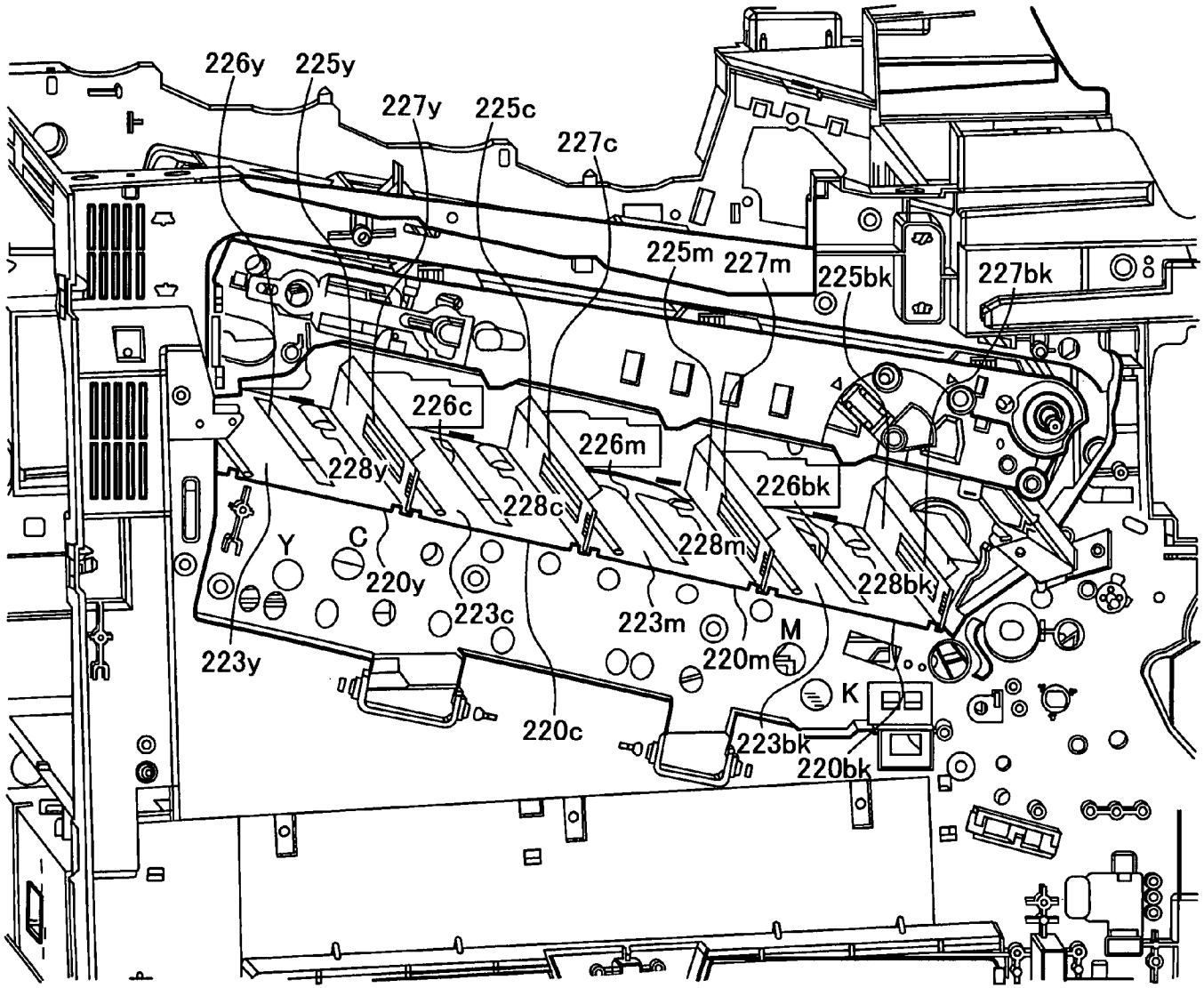
FIG. 12 illustrates a partial perspective view of the image forming apparatus of FIG. 16, showing an inside of the image forming apparatus with the process cartridges removed.
Figure 13:
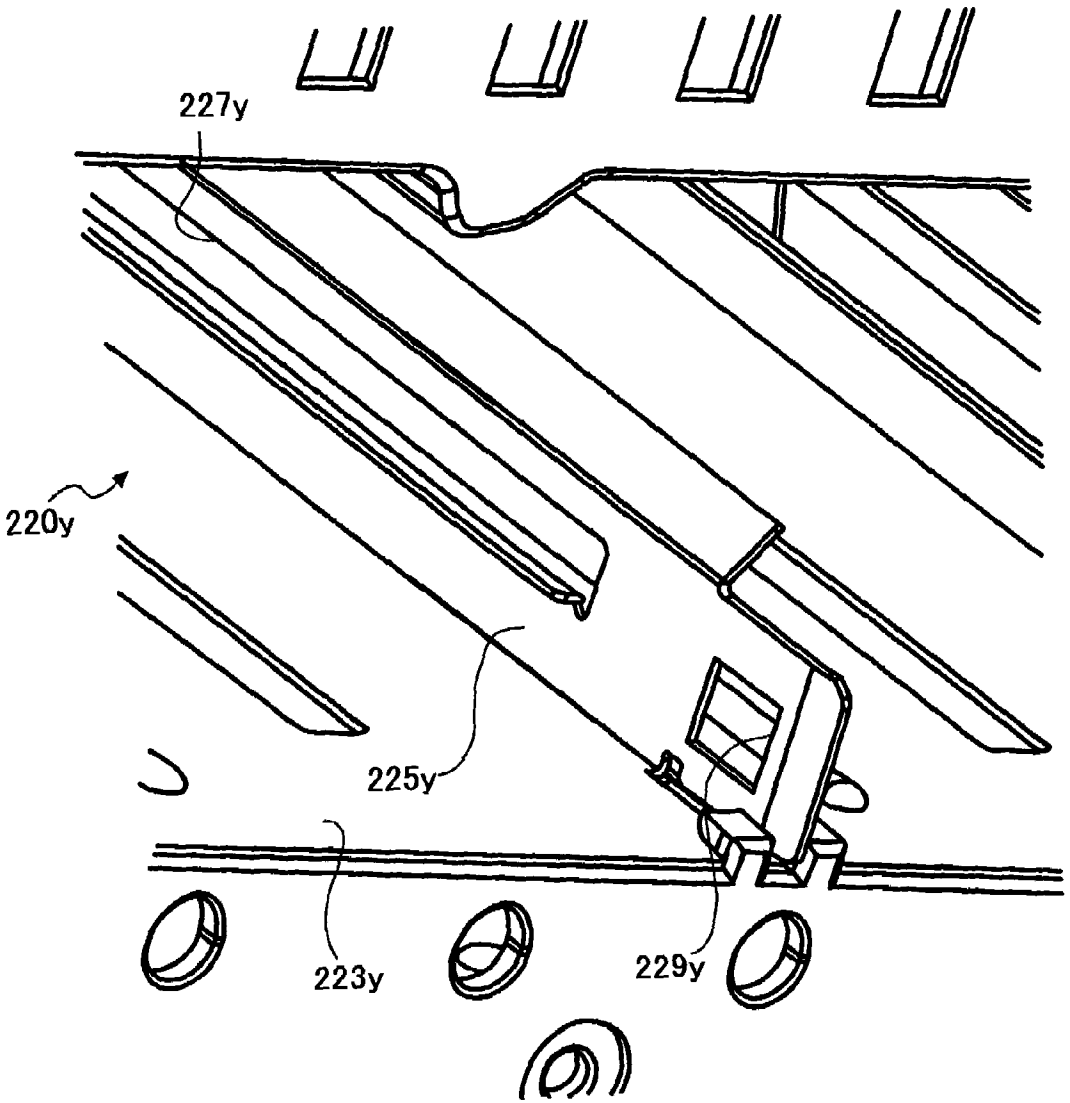
FIG. 13 illustrates an enlarged view of a guide portion of the image forming apparatus of FIG. 16.
Figure 14:
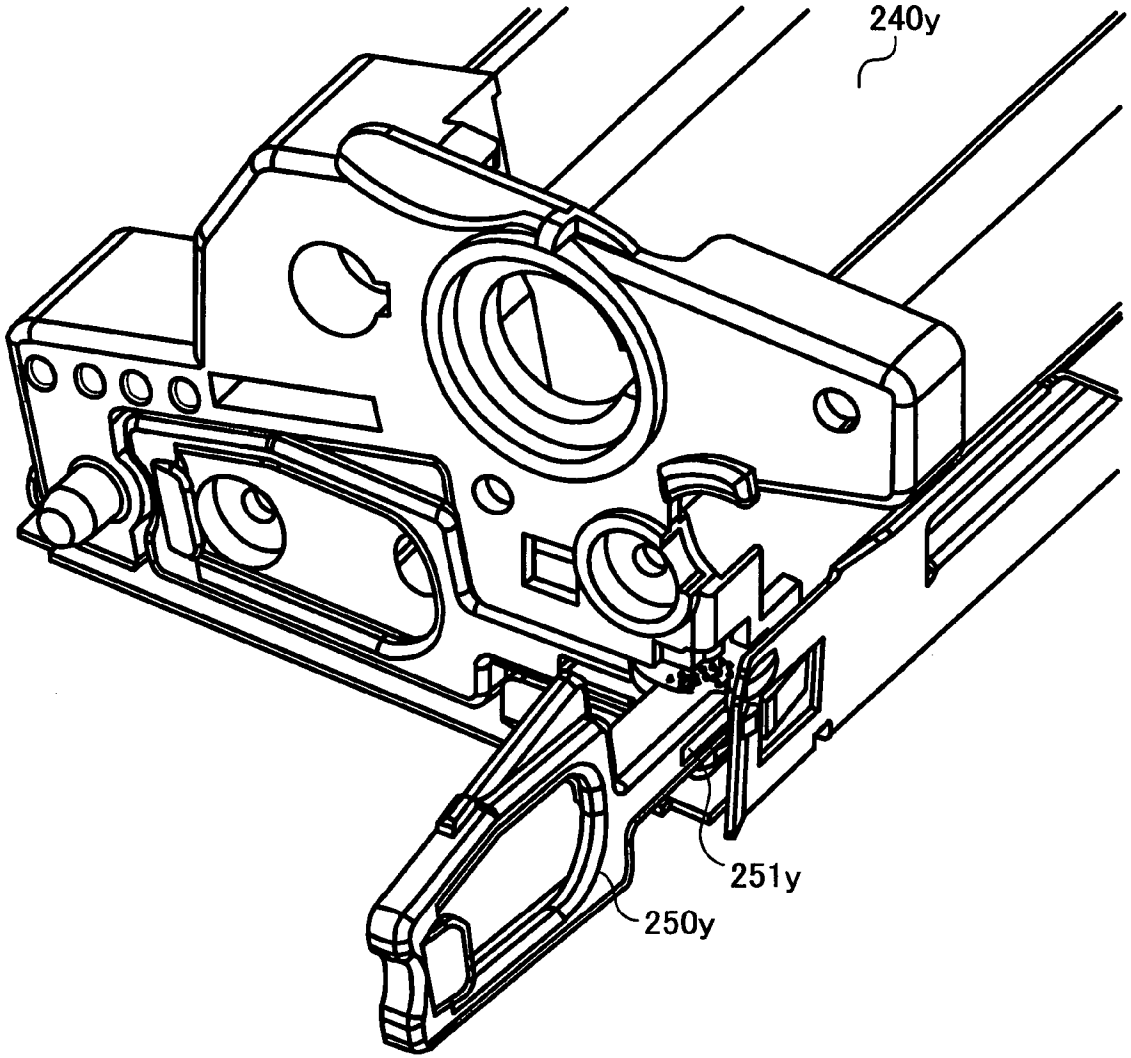
FIG. 14 illustrates a partial perspective view of a process cartridge with a lever positioned to release the process cartridge from the guide portion.
Figure 15:
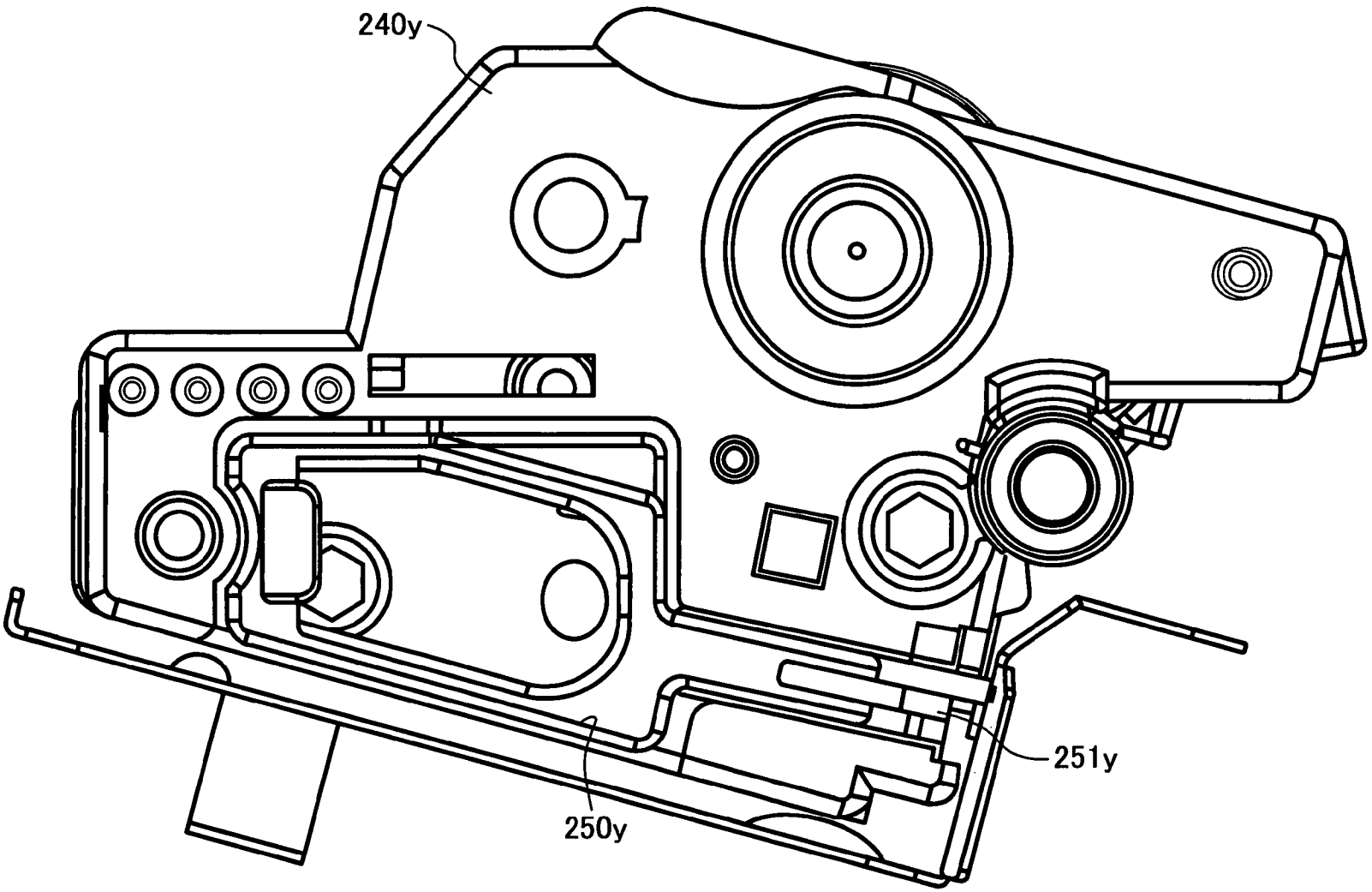
FIG. 15 illustrates a side view of the process cartridge with the lever positioned to lock the guide portion.

As shown in FIG. 12, the guide portions 220*y*, 220*c*, 220*m*, and 220*bk* of the image forming apparatus 200 include supporting surfaces 223*y*, 223*c*, 223*m*, and 223*bk*, and regulating members 225*y*, 225*c*, 225*m*, and 225*bk*. The supporting surfaces 223*y*, 223*c*, 223*m*, and 223*bk* include light passing windows 226*y*, 226*c*, 226*m*, and 226*bk*, and pushup members 228*y*, 228*c*, 228*m*, and 228*bk*. The regulating members 225*y*, 225*c*, 225*m*, and 225*bk* include guide openings 227*y*, 227*c*, 227*m*, and 227*bk*. FIG. 13 illustrates a positioning hole 229*y* of the regulating member 225*y*.

Further, while each of the supporting surfaces 143*y*, 143*c*, 143*m*, and 143*bk* of corresponding guide portions 142*y*, 142*c*, 142*m*, and 142*bk* is arranged approximately horizontally in the image forming apparatus 100, each of the supporting surfaces 223*y*, 223*c*, 223*m*, and 223*bk* of corresponding guide portions 220*y*, 220*c*, 220*m*, and 220*bk* is arranged to be inclined relative to a horizontal plane in the image forming apparatus 200.

Figure 16:
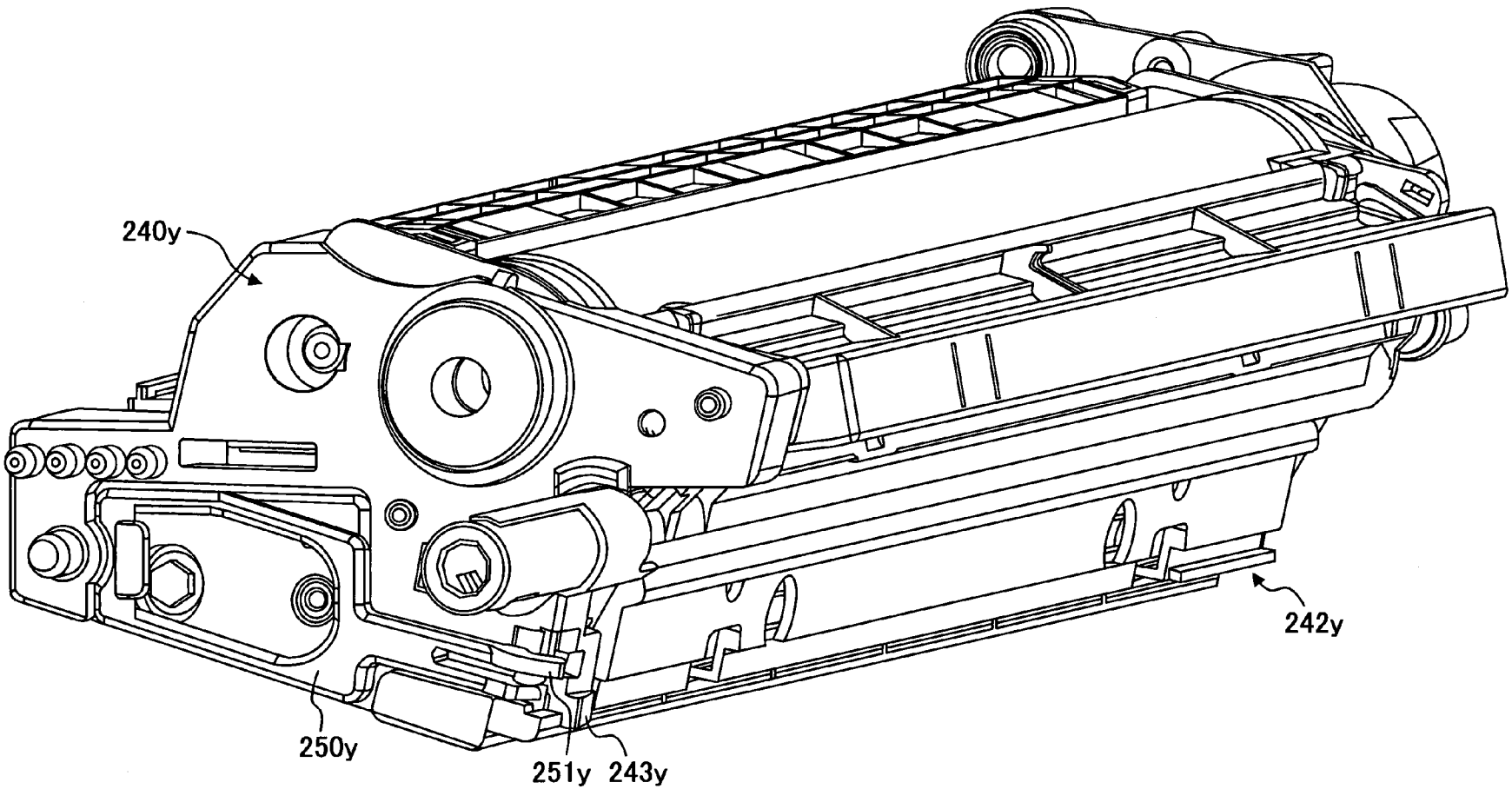
FIG. 16 illustrates a rear-side perspective view of the process cartridge.

The process cartridges 240*y*, 240*c*, 240*m*, and 240*bk* of the image forming apparatus 200, shown in FIG. 11, are similar to the process cartridges 140*y*, 140*c*, 140*m*, and 140*bk*, respectively, of the image forming apparatus 100, shown in FIG. 6, with the exception of the guide portion 220*y*, for example, a convex portion 242*y*, a positioning latch 243*y*, a lever 250*y*, and a cam 251*y*, as shown in FIG. 16.

This structure allows a sliding movement of each of the process cartridges 240*y*, 240*c*, 240*m*, and 240*bk* in a stable manner. More specifically, the process cartridge 240*y* slidably moves on the guide portion 220*y* while pressing down both the supporting surface 223*y* and the regulating member 225*y* by its own weight, thereby avoiding undesirable movements of the process cartridge 240*y* in a direction parallel to the supporting surface 223*y*.

Detailed structures of the guide portions 220*y*, 220*c*, 220*m*, and 220*bk* and the process cartridges 240*y*, 240*c*, 240*m*, and 240*bk* different from those of the guide portions 142*y*, 142*c*, 142*m*, and 142*bk*, and the process cartridges 140*y*, 140*c*, 140*m*, and 140*bk* will now be described.

FIG. 12 shows the inside of the image forming apparatus 200 when the process cartridges 240*y*, 240*c*, 240*m*, and 240*bk* are removed. Each of the guide portions 220*y*, 220*c*, 220*m*, and 220*bk* has an L-shaped form. The supporting surfaces 223*y*, 223*c*, 223*m*, and 223*bk* support the bottom surfaces of the process cartridges 240*y*, 140*c*, 240*m*, and 240*bk*, respectively. The light passing windows 226*y*, 226*c*, 226*m*, and 226*bk* are included in the supporting surfaces 223*y*, 223*c*, 223*m* and 223*bk*, respectively. Each of the light passing windows 226*y*, 226*c*, 226*m*, and 226*bk* passes a laser beam emitted by an optical writing system which is positioned under the guide portions 220*y*, 220*c*, 220*m*, and 220*bk*. The supporting surfaces 223*y*, 223*c*, 223*m*, and 223*bk* include pushup members 228*y*, 228*c*, 228*m*, and 228*bk*, respectively. The pushup members 228*y*, 228*c*, 228*m*, and 228*bk* guide the process cartridges 240*y*, 240*c*, 240*m*, and 240*bk*, respectively, such that the process cartridges 240*y*, 240*c*, 240*m*, and 240*bk* are pushed up to positions contacting the intermediate transfer belt. The regulating members 225*y*, 225*c*, 225*m*, and 225*bk* are arranged approximately perpendicular to the supporting surfaces 223*y*, 223*c*, 223*m*, and 223*bk*, respectively. The regulating members 225*y*, 225*c*, 225*m*, and 225*bk* regulate movement of the process cartridges 240*y*, 240*c*, 240*m*, and 240*bk*, respectively, to precise positions. The regulating members 225*y*, 225*c*, 225*m*, and 225*bk* include guide openings 227*y*, 227*c*, 227*m*, and 227*bk* and positioning holes 229*y*, 229*c*, 229*m*, and 229*bk*, respectively. Each of the guide openings 227*y*, 227*c*, 227*m*, and 227*bk* guides a corresponding one of the process cartridges 240*y*, 240*c*, 240*m*, and 240*bk*. Each of the positioning holes 229*y*, 229*c*, 229*m*, and 229*bk* is positioned at one edge side of the regulating member close to the cover plate 171, and determines a preliminary operable position of a corresponding one of the process cartridges 240*y*, 240*c*, 240*m*, and 240*bk*, respectively.

Referring to FIGS. 8 through 12, the guide portion 220*y* and the process cartridge 240*y* are primarily shown. The guide portions 220*y*, 220*c*, 220*m*, and 220*bk* have identical structures. The process cartridges 240*y*, 240*c*, 240*m*, and 240*bk* also have identical structures with toners different in colors from each other.

FIG. 13 shows an enlarged view of the guide portion 220*y*. When the process cartridge 240*y* is slid on the angled supporting surface 223*y*, the process cartridge 240*y* presses by its own weight the supporting surface 223*y* such that undesirable movements in a direction different from the sliding direction are eliminated. The convex portion 242*y*, shown in FIG. 16, is included at a leading portion of the process cartridge 240*y* and is configured to be engaged with the guide opening 227*y* formed on the regulating member 225*y* of the guide portion 220*y*. This regulates movements of the process cartridge 240*y* towards the intermediate transfer belt such that the process cartridge 240*y* may maintain a distance from the intermediate transfer belt. This prevents damage to a photoconductive drum of the process cartridge 240*y* and the intermediate transfer belt. When the process cartridge 240*y* is inserted into the image forming apparatus 200 a certain distance corresponding to a predetermined length of the guide portion 220*y*, the convex portion 242*y* of the process cartridge 240*y* moves off the guide opening 227*y*. Then, as the process cartridge 240*y* is inserted, the process cartridge 240*y* is lifted in a vertical direction by and onto the pushup member 228*y* of the supporting surface 223*y*. As a result, the photoconductive drum of the process cartridge 240*y* contacts the intermediate transfer belt.

To avoid damage to the intermediate transfer belt, the process cartridge 240*y* is preferably separated from the intermediate transfer belt when the process cartridge 240*y* is installed. However, the process cartridge 240*y* needs to be set to a predetermined preliminary position and held in contact with the intermediate transfer belt to perform the image forming operation. As previously described, when the process cartridge 240*y* is inserted into the image forming apparatus 200, it is guided by the guide opening 227*y* of the regulating member 225*y* and the pushup member 228*y* of the supporting surface 223*y*. At the preliminary position, the positioning latch 243*y* of the process cartridge 240*y* is kept into the positioning hole 229*y* of the guide portion 220*y* such that the positioning latch 243*y* and the positioning hole 229*y* are engaged to determine the preliminary position of the process cartridge 240*y*. The process cartridge 240*y* located at the preliminary position is fixed to a precise position by closing the cover plate 171.

FIGS. 11, 12, and 14–17 show installation and removal of the process cartridge 240*y*. In this embodiment of the present invention, the image forming apparatus 200 has the positioning hole 229*y* and the positioning latch 243*y*. When the process cartridge 240*y* is inserted, the positioning latch 243*y* of the process cartridge 240*y* fits in the positioning hole 229*y* of the guide portion 220*y* by the weight of the process cartridge 240*y*. Thus, the process cartridge 240*y* is set to the preliminary position and a locking pressure is applied such that the process cartridge 240*y* is locked. The process cartridge 240*y* is then fixed to the precision position by the cover plate 171 as previously described. To 5 release the process cartridge 240*y* from its precise position, the lever 250*y* of the process cartridge 240*y* is used.

As previously described, the process cartridge 240*y* has the lever 250*y* which is arranged at a position close to the 10 positioning latch 243*y*. The lever 250*y* is pulled out, and the cam 251*y* provided at a hinge portion of the lever 250*y* contacts the regulating member 225*y* of the guide portion 220*y* and pushes up the process cartridge 240*y*. The positioning latch 243*y* of the process cartridge 240*y* is disengaged from 15 the positioning hole 229*y* of the guide portion 220*y*. The process cartridge 240*y* is then easily removed by pulling the lever 250*y*.

Figure 17:
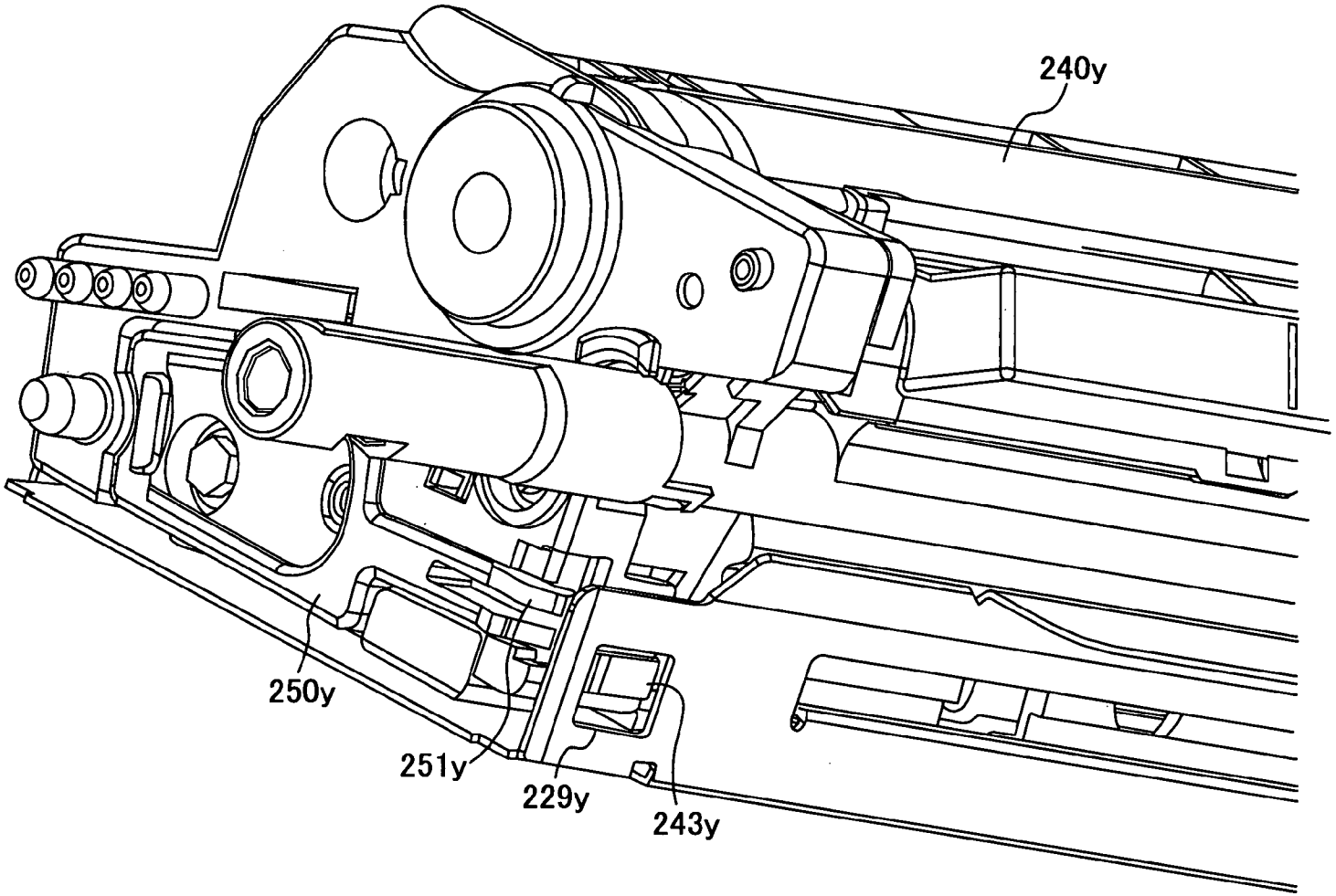
FIG. 17 illustrates an enlarged, rear-side, partial view of the process cartridge.

FIG. 16 is a perspective view of the process cartridge 240*y* and FIG. 17 is an enlarged view of a part of the process 20 cartridge 240*y*. A bottom side of the process cartridge 240*y* is formed approximately flat so that the process cartridge 240*y* is smoothly inserted along the guide portion 220*y*. The convex portion 242*y* of the process cartridge 240*y* is arranged at a lower part of the process cartridge 240*y* to face the 25 regulating member 225*y* and to be close to the pushup member 228*y* when the process cartridge 240*y* is in an operational position.

A process cartridge having a structure of the present invention may easily and smoothly be installed and removed along a guide member eliminating undesirable movements by its own weight.

Similar to the image forming apparatus 100, the image forming apparatus 200 of the present invention includes toner bottles (not shown in FIG. 11) which are separately mounted to the process cartridges 240*y*, 240*c*, 240*m*, and 240*bk*. Namely, the toner bottles may be replaced separately from the process cartridges 240*y*, 240*c*, 240*m*, and 240*bk* when toner needs to be replenished. Also, the process cartridges 240*y*, 240*c*, 240*m*, and 240*bk* may be replaced separately from the toner bottles when a component needs to be replaced.

Numerous additional modifications and variations are possible in light of the above teachings. It is therefore to be understood that within the scope of the appended claims, the disclosure of this patent specification may be practiced otherwise than as specifically described herein.

What is claimed is:

1. A process cartridge having first and second sides and a bottom portion and being configured to be detachably mounted to an image forming apparatus, said cartridge comprising:

a photoconductive element; and a housing configured to house said photoconductive element, said housing comprising first and second guide portions integrally formed and configured to guide the process cartridge in and out of the image forming apparatus, the first guide portion being disposed on the first side of the process cartridge on a first location and the second guide portion being disposed on the second side of the process cartridge on a second location lower than the first location with respect to a vertical direction, wherein at least one of said first or second guide portions is configured to couple directly to an adjoining guide portion of an adjoining process cartridge.

2. The process cartridge according to claim 1, wherein said first or second guide portion faces an inner wall of the image forming apparatus or another process cartridge adjoining said process cartridge.

3. The process cartridge according to claim 1, wherein said first or second guide portion is configured to guide another process cartridge adjoining said process cartridge.

4. The process cartridge according to claim 1, wherein said first or second guide portion is configured to slidably engage with a portion of another process cartridge adjoining said process cartridge.

5. The process cartridge according to claim 1, wherein a shape of said guide first and second portions depends on a location of said first and second guide portions in the image forming apparatus.

6. The process cartridge according to claim 1, wherein a configuration of said first and second guide portions is one of being separately formed from said housing or being integrated with said housing.

7. An image forming apparatus, comprising:

an image transfer mechanism; and at least one process cartridge having first and second sides and a bottom portion and being configured to be detachably mounted, the process cartridge comprising:

a photoconductive element; and a housing configured to house said photoconductive element, said housing comprising first and second guide portions integrally formed and configured to guide the process cartridge in and out of the image forming apparatus, the first guide portion being disposed on the first side of the process cartridge on a first location and the second guide portion being disposed on the second side of the process cartridge on a second location lower than the first location with respect to a vertical direction, wherein at least one of said first or second guide portions is configured to couple directly to an adjoining guide portion of an adjoining process cartridge.

8. The image forming apparatus according to claim 7, wherein the adjacent process cartridges are positioned within the image forming apparatus on a slope with respect to the horizontal direction.

9. An image forming apparatus, comprising:

an image transfer mechanism; and a plurality of process cartridges detachably mounted to said image forming apparatus, each process cartridge of the plurality of process cartridges being arranged parallel to the others and forming an image of a single color, each of the process cartridges having first and second sides and a bottom portion and comprising:

a photoconductive element; and a housing configured to house said photoconductive element, said housing comprising first and second guide portions integrally formed and configured to guide the process cartridge in and out of the image forming apparatus, the first guide portion being disposed on the first side of the process cartridge on a first location and the second guide portion being disposed on the second side of the process cartridge on a second location lower than the first location with respect to a vertical direction, wherein at least one of said first or second guide portions is configured to couple directly to an adjoining guide portion of an adjoining process cartridge.

10. The image forming apparatus according to claim 9, wherein the adjacent process cartridges are positioned within the image forming apparatus on a slope with respect to the horizontal direction.

11. A method of providing a process cartridge having first and second sides and a bottom portion and being configured to be detachably mounted in an image forming apparatus, the method comprising:

providing a photoconductive element; and a housing configured to house said photoconductive element, said housing comprising first and second guide portions integrally formed and configured to guide the process cartridge in and out of the image forming apparatus, the first guide portion being disposed on the first side of the process cartridge on a first location and the second guide portion being disposed on the second side of the process cartridge on a second location lower than the first location with respect to a vertical direction, wherein at least one of said first or second guide portions is configured to couple directly to an adjoining guide portion of an adjoining process cartridge.

12. The method according to claim 11, wherein said storing further comprises arranging said first or second guide portion to face an inner wall of the image forming apparatus or another process cartridge adjoining said process cartridge.

13. The method according to claim 11, wherein said first or second guide portion is configured to guide another process cartridge adjoining said process cartridge.

14. The method according to claim 11, wherein said first or second guide portion is configured to slidably engage with a portion of another process cartridge adjoining said process cartridge.

15. The method according to claim 11, wherein a shape of said first or second guide portion depends on a location of said first or second guide portion in the image forming apparatus.

16. The method according to claim 11, wherein a configuration of said first or guide portion is one of being separately formed from said housing or being integrated with said housing.

17. A method of making an image forming apparatus, the method comprising:

providing an image transfer mechanism; and providing a process cartridge having first and second sides and a bottom portion and being configured to be detachably mounted in said image forming apparatus, the process cartridge comprising:

a photoconductive element; and a housing configured to house said photoconductive element, said housing comprising first and second guide portions integrally formed and configured to guide the process cartridge in and out of the image forming apparatus, the first guide portion being disposed on the first side of the process cartridge on a first location and the second guide portion being disposed on the second side of the process cartridge on a second location lower than the first location with respect to a vertical direction, wherein at least one of said first or second guide portions is configured to couple directly to an adjoining guide portion of an adjoining process cartridge.

18. A method of making an image forming apparatus, the method comprising:

providing an image transfer mechanism; and providing a plurality of process cartridges, each process cartridge of said plurality being detachably mounted to said image forming apparatus, being arranged in parallel to the other cartridges, and being configured to form an image of a single color, each one of the process cartridges having first and second sides and a bottom portion and comprising:

a photoconductive element; and a housing configured to house said photoconductive element, said housing comprising first and second guide portions integrally formed and configured to guide the process cartridge in and out of the image forming apparatus, the first guide portion being disposed on the first side of the process cartridge on a first location and the second guide portion being disposed on the second side of the process cartridge on a second location lower than the first location with respect to a vertical direction, wherein at least one of said first or second guide portions is configured to couple directly to an adjoining guide portion of an adjoining process cartridge.

* * * * *